US006592202B2

(12) United States Patent
Udagawa et al.

(10) Patent No.: US 6,592,202 B2
(45) Date of Patent: Jul. 15, 2003

(54) LIQUID EJECTION RECORDING HEAD AND LIQUID EJECTION TYPE RECORDING DEVICE

(75) Inventors: Kenta Udagawa, Kanagawa-ken (JP); Mineo Kaneko, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/900,879

(22) Filed: Jul. 10, 2001

(65) Prior Publication Data

US 2002/0048477 A1 Apr. 25, 2002

(30) Foreign Application Priority Data

Jul. 10, 2000 (JP) ..... 2000-209028

(51) Int. Cl.[7] ..... B41J 2/15
(52) U.S. Cl. ..... 347/40; 347/43
(58) Field of Search ..... 347/40, 43, 12, 347/15

(56) References Cited

U.S. PATENT DOCUMENTS 4,614,953 A * 9/1986 Lapeyre ..... 347/43
5,677,718 A 10/1997 Crawford et al. ..... 347/92

FOREIGN PATENT DOCUMENTS

JP 63 280649 11/1988
JP 09 314832 12/1997

* cited by examiner

*Primary Examiner*—Lamson Nguyen
(74) *Attorney, Agent, or Firm*—Fitzpatrick, Cella, Harper & Scinto

(57) ABSTRACT

A liquid ejection recording head includes a plurality of arrays of ejection outlets for ejecting the same liquid; common chambers, provided for respective arrays of the ejection outlets, for supplying the liquid to the arrays of the ejection outlets, respectively; a liquid inlet for receiving the liquid from outside of the liquid recording head; a common passage in fluid communication with the liquid inlet; and branched passages branched from the common passage and in fluid communication with the common chambers, respectively, wherein the branched passages have liquid supply properties which are equivalent to each other.

15 Claims, 15 Drawing Sheets

(a)

(b)

(c)

LIQUID EJECTION RECORDING HEAD AND LIQUID EJECTION TYPE RECORDING DEVICE

BACKGROUND OF THE INVENTION

Field of the Invention and Related Art

The present invention relates to a liquid ejection recording head which ejects different kinds of liquid, such as inks of different colors, onto a recording material such as paper, and more particularly, to a liquid ejection recording head usable with a bi-directional printing apparatus in which the recording is effected with bi-directional scanning of the recording head.

In the field of printing apparatus, particularly ink jet type printing apparatus, there is a demand for high-speed color printing. Various methods adopted for the improvement of recording speed include increasing the length of the recording head, increasing the printing frequency, adopting bi-directional printing, etc. Bi-directional printing is advantageous in the total cost since the necessary energy is dispersed in time for the same throughput as compared with unidirectional printing.

Japanese Laid-Open Patent Application 58-179653 discloses use of forward path nozzles and backward path nozzles as a solution to the problem. In this publication, the operating heads (ejection portions) are switched as between the forward path and the backward path so as to make the orders of ink shots the same irrespective of the scanning direction. The recording head portion comprises a combination of recording heads for ejecting Y (yellow), M (magenta), C (cyan) and Bk (black) inks, respectively. More particularly, as shown in FIG. 3 of that publication, the recording heads are arranged such that Bk, C, M, Y, M, C, and Bk inks are ejected, in this order, both in the forward scanning and the backward scanning. The ink supply to the head portions is made through pipes for the respective heads from the associated ink containers.

However, with the arrangement disclosed in Japanese Laid-Open Patent Application 58-179653, the apparatus is bulky because of the space occupied by the ink supply pipes and the structures for removing bubbles in the pipes.

In view of this, it would be considered, from the standpoint of downsizing the apparatus, that an ink container could be provided for each of the recording heads, with the recording heads and ink containers on a carriage, and bidirectional scanning being used. However, this would result in bulkiness of the carriage, heaviness of the whole apparatus, and an increase in the number of parts, with a resulting cost increase. When use is made of a plurality of ink containers for the same color, the number of ink containers at the time of beginning of use of the apparatus, and therefore the initial cost, are relatively large. Additionally, when it becomes necessary to replace one of the same-color ink containers due to the consumption of the ink, it might not be readily apparent to the user which container should be replaced.

It might also be considered, in an attempt to avoid this problem, that only one ink container is used for the recording heads (ejecting portions) for ejecting ink of a given color. Then, however, the liquid supply passage to the same-color ejection portions from the single container has to be branched. This would result in nonuniform ink supply properties and, therefore, nonuniform ink ejection properties.

More particularly, the printing may be influenced by an increase of flow pressure (resistance) against the ink flow from the ink container to the ejection portion during ink supply (the pressure loss being determined by the length of the supply passage, the supply passage cross-sectional area, the maximum flow speed, the ink viscosity, and so on). If the difference in the pressure losses is large, the ink ejection properties may be different in different ejection portions, and the bubble removing properties may differ significantly. For this reason, it is desirable that pressure loss differences among the ejection portions are small.

SUMMARY OF THE INVENTION

Accordingly, it is a principal object of the present invention to provide a liquid ejection recording head and a liquid ejection type recording device in which a recording head and an ink container are carried on a carriage and in which only one ink container is sufficient to cover the same color recording heads, wherein the differences the ink supply properties among in the same-color ejecting portions or the similar color ejecting portions are small.

According to an aspect of the present invention, there is provided a liquid ejection recording head comprising:

a plurality of arrays of ejection outlets for ejecting the same liquid;

common chambers, provided for respective arrays of the ejection outlets, for supplying the liquid to the arrays of the ejection outlets, respectively;

a liquid inlet for receiving the liquid from an outside of said liquid recording head;

a common passage in fluid communication with said liquid inlet;

branched passages branched from said common passage and in fluid communication with said common chambers, respectively, wherein said branched passages have liquid supply properties which are equivalent to each other.

According to another aspect of the present invention, there is provided a liquid ejection recording head comprising:

a first plurality of arrays of first ejection outlets for ejecting the same first liquid;

a second plurality of arrays of second ejection outlets for ejecting the same second liquid, which is different from the first liquid;

a third plurality of arrays of third ejection outlets for ejecting the same third liquid, which is different from the first liquid and from the second;

first common chambers, provided for respective first arrays of the ejection outlets, for supplying the first liquid to the first arrays of the ejection outlets, respectively;

second common chambers, provided for respective second arrays of the ejection outlets, for supplying the second liquid to the second arrays of the ejection outlets, respectively;

third common chambers, provided for respective third arrays of the ejection outlets, for supplying the third liquid to the third arrays of the ejection outlets, respectively;

a first liquid inlet for receiving the first liquid from outside of said liquid recording head;

a second liquid inlet for receiving the second liquid from outside of said liquid recording head;

a third liquid inlet for receiving the third liquid from outside of said liquid recording head;

a first common passage in fluid communication with said first liquid inlet;

a second common passage in fluid communication with said second liquid inlet;

a third common passage in fluid communication with said second liquid inlet and with said third common chamber;

first branched passages branched from said first common passage and in fluid communication with said first common chambers, respectively, and second branched passages branched from said second common passage and in fluid communication with said second common chambers, respectively, wherein said first branched passages have liquid supply properties which are equivalent to each other, and said second branched passages have liquid supply properties which are equivalent to each other.

According to these aspects of the present invention, the possible coloring non-uniformity attributable to the orders of shots of recording droplets particularly in the bi-directional printing operation can be avoided.

According to these aspects of the present invention, only one container is provided for each of different liquids, and therefore, the carriage can be downsized. In addition, the container exchange when the liquid is consumed, is the same as in conventional recording heads which are arranged asymmetrically, and therefore, the replacement is easy for the operator.

It may preferably be that said branched passages are symmetrical with respect to a line perpendicular to a scanning line along which said recording head is moved for scanning.

It may preferably be that said common passage and branched passages constitute a Y-shape. By virtue of this feature, compact arrangement of passages in the liquid jet recording head is accomplished.

In addition, the resistances (pressure loss determined by the length of the supply passage, the supply passage cross-sectional area, the maximum flow speed, the ink viscosity, and so on), for the same kinds of the liquids, against the flow of the liquid from containers to the ejection outlets are substantially the same. As a result, the liquid ejection properties and the bubble removal properties in the supply passages are the same among the ejection outlet arrays for the same kinds of liquids.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 6(*d*) is an illustration showing the parts shown in FIG. 6(*a*) and FIG. 6(*c*), assembled.

DESCRIPTION OF THE PREFERRED EMBODIMENTS

Hereinafter, preferred embodiments of the present invention will be described with reference to the appended drawings.

Embodiment 1

Figure 1:
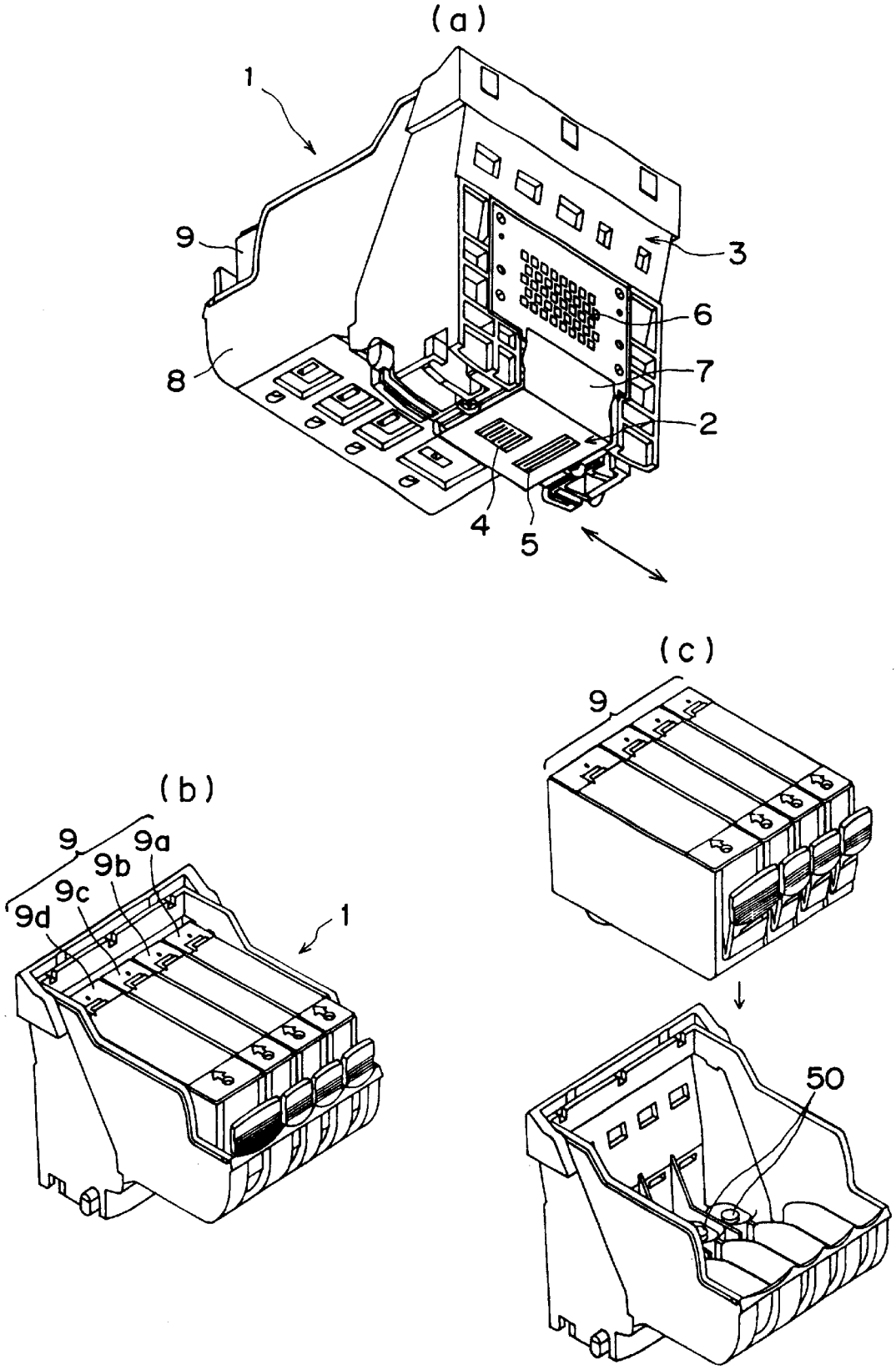
FIG. 1 is an assembling perspective view of a recording head cartridge in an example of a liquid ejection recording head according to an embodiment of the present invention.

FIG. 1 is a perspective view of a recording head cartridge, or an example of a liquid ejection recording head, in accordance with the present invention; FIG. 1(*a*) is a perspective view of the cartridge as seen from the ejection orifice side; FIG. 1(*b*) is a perspective view of the cartridge as seen from the ink container mounting side; and FIG. 1(*c*) is a perspective view of the cartridge, from which the ink containers have been removed, as seen from the ink container mounting side.

The head cartridge 1 configured as shown in the drawing comprises a recording unit 2 and an ink supplying unit 3. The recording unit 2 comprises: a recording head portion having a color recording element 4 for recording cyan (C), magenta (M), and yellow (Y) colors, and a recording element 5 for recording black (Bk) color, an electrical contact portion 6 which is connected to the electrical contact portion of a recording apparatus, which will be described later, as the recording head cartridge 1 is mounted into the recording apparatus; and a flexible wiring board 7 for electrically connecting the electrical contact portion 6 and the contact pad (unshown) of the aforementioned recording head portion. On the other hand, the ink supplying unit 3 comprises: a holder portion 8 for holding ink containers 9*a*–9*d* for separately containing four color inks (C, M, Y, and Bk), one for one; and an ink supply path formation assembly (unshown) for forming ink supply paths from the ink containers 9 to corresponding columns of ejection orifices.

Recording Head Portion

Figure 2:
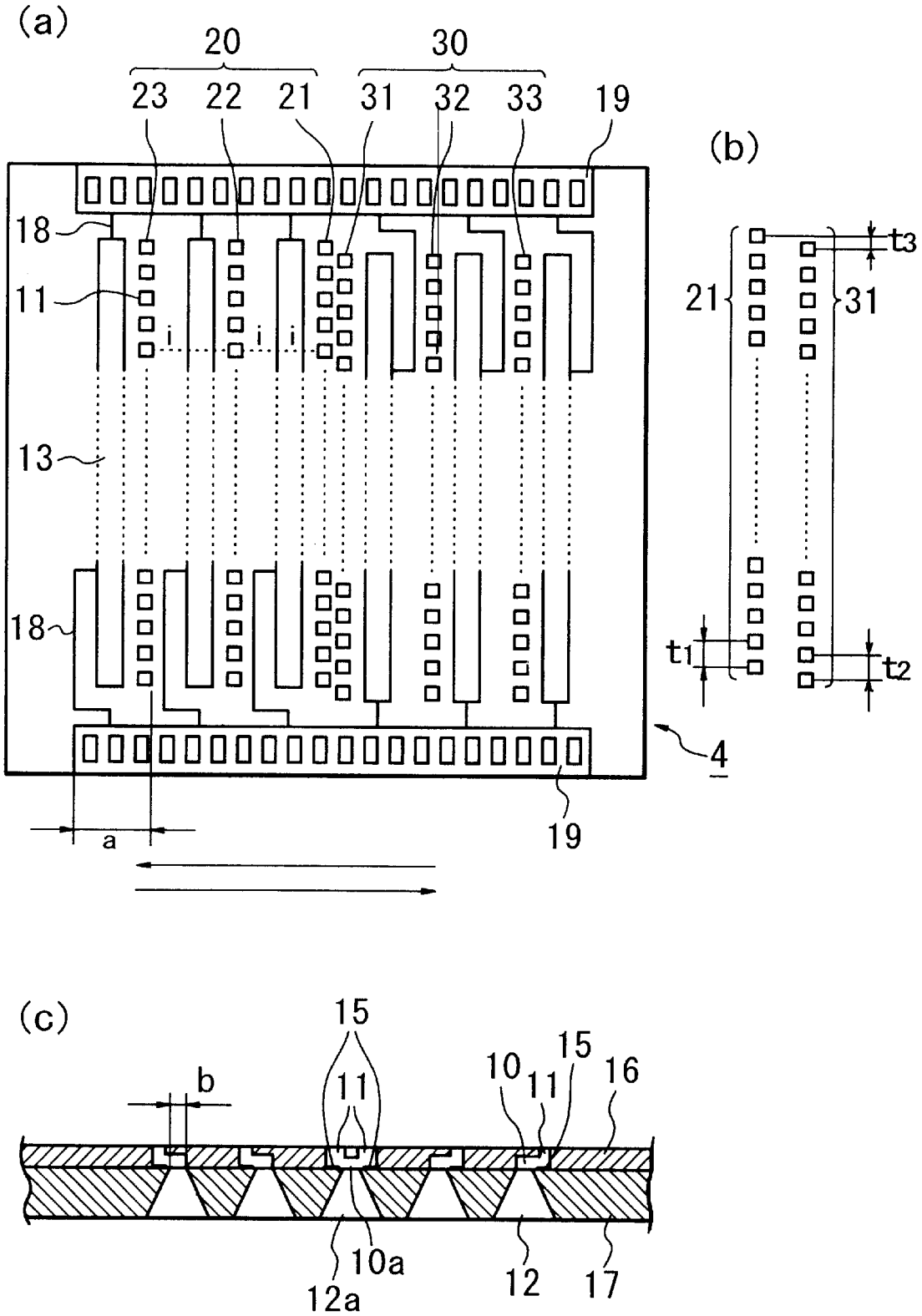
FIG. 2 is a schematic illustration of a major part of a color recording element of a recording head in the recording unit used in the device shown in FIG. 1.

First, the recording head portion in this embodiment will be described in detail. FIG. 2 is a rough drawing of the essential portions of the color recording element of the recording head portion of the recording unit shown in FIG. 1: FIG. 2(*a*) is a rough drawing of the essential portion, as seen from above; FIG. 2(*b*) is a rough drawing for depicting the arrangement of the ejection orifices; and FIG. 2(*c*) is a sectional view of the essential portion of the recording head.

As described above, the recording head portion in this embodiment is equipped with the recording element 4 for recording three colors, or cyan (C), magenta (M), and yellow (Y) colors, and the recording element 5 for recording black color.

Referring to FIG. 2(*c*), these recording elements comprise a substrate 17 which integrally holds a plurality of heat generating elements 15 as energy transducing elements, and an orifice plate 16 which has a plurality of ejection orifices 11. The substrate 17 is formed of a single silicon crystal with a plane orientation of <100>, and integrally holds: a plurality of straight columns of heat generating elements 15; a plurality of driving circuits 13 for driving the plurality of heat generating element columns; a pair of contact pads 19 for connecting the recording head portion to external sources: wires 18 connecting the driving circuits 13 and contact pads 19, and the like, which have been formed through a microchip manufacturing process. The substrate 17 is also provided with five through holes, which are formed by anisotropic etching and are located in the areas excluding the areas in which the above described circuits 13, elements 15, wires 18, and the like are located. One end of each of these through holes 5 constitutes ink supply openings 12 and 12*a* through which liquids are supplied to the ejection orifice columns 21–23, and 31–33. Incidentally, FIG. 2(*a*) is a rough plan view of the substrate 17, in which the substrate 17 is drawn as if the orifice plate 16 covering the substrate 17 is virtually transparent, and the aforementioned heat generating elements and ink supply holes are not shown.

The orifice plate 16 placed on top of the substrate 17 is formed of photosensitive epoxy resin. It is provided with the ejection orifices 11 and liquid paths 10, which are formed with the use of photolithography technologies, and are aligned with the above-described heat generating elements 15.

These recording elements record an image by ejecting liquid such as ink from the ejection orifices. More specifically, in the recording elements, thermal energy is generated by the heat generating elements 15, and the thermal energy causes the film-boiling of the liquid, thus generating bubbles. As a result, the liquid is ejected from the ejection orifices 11 by the pressure generated by the growth of the bubbles, and forms an image. Further, as the electrical contact portion (reference character 6 in FIG. 1) connected to the wiring board is connected to the electrical connecting portion of the recording apparatus, which will be described later, by connecting the compact pads 19 to the flexible wiring board (reference character 7 in FIG. 1), the recording head cartridge 1 is enabled to receive driving signals or the like from the recording apparatus. Further, the ink supply holes 12 and 12*a*, and the like, of the recording elements are connected to the ink containers different in ink color, one for one, through an ink supply path formation assembly, which will be described later.

Further, the color recording element 4 in this embodiment is provided with a plurality of ejection orifices 11, which are aligned in a plurality of straight lines, forming ejection orifice columns (portions) 21–23 and 31–33, which are parallel to each other, and in which a predetermined number of ejection orifices 11 are placed at a predetermined interval. In FIG. 2(*a*), the i-th ejection orifices in the ejection lines 21–23 are aligned straight in the direction indicated by an arrow mark in FIG. 2(*a*). In other words, the i-th ejection orifices in the ejection lines 21–23 are positioned so that they are aligned in the direction in which the recording elements are moved in the scanning manner after being mounted into the recording apparatus or the like, which will be described later. The ejection orifice columns 21–23 together constitute a first ejection orifice column group. The same is true of the ejection orifice columns 31–33, and the ejection orifice columns 31–33 together constitute a second ejection orifice column group 30, which is located immediately adjacent to the first ejection orifice column group 20. It is assumed here that among the six ejection orifice columns, that is, the sum of the three ejection orifice columns in the first ejection orifice group 20 and the three ejection orifice columns in the second orifice line group 30, the most outward ejection orifice columns, that is, the ejection orifice columns 23 and 33, with respect to the center line of the recording element in terms of the direction of the arrow mark, eject cyan (C) ink, and the ejection orifice columns 22 and 32 eject magenta (M) ink; and the most inward ejection orifice columns, that is, the ejection orifice columns 21 and 31, which are immediately adjacent to each other, eject yellow (Y) ink.

Thus, to the ink supply hole 12*a* (ink supply hole located at the center), yellow ink is supplied from an ink container dedicated to yellow ink, and to the two ink supply holes 12 sandwiching the ink supply hole 12*a*, magenta ink is supplied from an ink container dedicated to magenta ink. To the outwardmost two ink supply holes 12, cyan ink is supplied from an ink container dedicated to cyan ink. As is evident from the above description, the central ink supply hole 12*a* supplies ink to two ejection orifice columns 21 and 31, and the ink supply hole 12*a* and liquid path 10*a* function as a common liquid chamber for the ejection orifice columns 21 and 31.

Positioning the two ejection orifice columns, which are different in the ejection orifice column group to which they belong, but are the same in the type of liquid they eject, at the center of the recording element, and virtually symmetrically positioning the rest of the ejection orifice columns, which are also different in terms of the ejection orifice column group, but are the same in ink color, and the driving circuits therefor, with respect to the center portion of the recording element, makes it possible to position the through holes as the ink supply holes 12 and 12*a*, driving circuits, heat generating elements, and the like, on the substrate, at an even interval and without waste of space, and, therefore, makes it possible to reduce the substrate size.

Further, symmetrically positioning the two ejection orifice columns, which are the same in the color of the liquid they eject, with respect to the center line of the recording element, makes the same, the order in which ink droplets different in color are placed in each picture element to generate an intended color on a recording medium when the recording element is moved in a manner to scan the recording medium in one direction, as when the recording element is moved in the other direction, and, therefore, makes the picture elements uniform in color development regardless of the direction of the scanning movement of the recording element, and thus prevents the picture elements from becoming nonuniform in color development due to the switching of the scanning movement direction of the recording element during printing.

Further, as is evident from FIGS. 2(*a*) and 2(*b*), the first and second ejection orifice column groups 20 and 30 are disposed slightly displaced from each other in terms of the direction in which the ejection orifices are aligned in each column, so that the ejection orifices in the ejection orifice columns 21–23, which together constitute the ejection orifice column group 20, and the ejection orifices in the ejection orifice columns 31–33, which together constitute the ejection orifice column group 30, compensate for each other in terms of the above described scanning movement direction of the recording element. Referring to FIG. 2(*b*), in this embodiment, in each of the ejection orifice columns which belong to the first ejection orifice column group 20 or second ejection orifice column group 30, 128 ejection orifices are aligned at a pitch (t1 or t2) of approximately 40 microns (1/600 inch, t1=t2 and approximately equals 40 microns). In terms of the secondary scanning direction of the recording element, the ejection orifice columns 21 and 31 are displaced from each other by a distance t3, which is equal to exactly half the pitch at which the ejection orifices are aligned in each column (t3=(½)t1 and approximately equals 20 microns).

With this ejection orifice placement, it is possible to print in a highly precise mode, that is, practically, at a dot pitch of 1,200 dpi (1,200 dots per inch).

On the other hand, in the case of the recording element for printing in black color, it is unnecessary for the ejection orifice columns to be symmetrically positioned, since it is generally used to print only in black color. Further, in order to improve the recording speed at which recording in black color, the black color recording element is provided with a larger number of ejection orifices than the color recording element. In this embodiment, the ejection orifice columns 40 and 41 for recording in black color are displaced from each other in the same manner as the ejection orifice columns 21 and 31 of the above described color recording element are displaced from each other, so that the ejection orifices compensate for each other in terms of the scanning movement direction of the black recording element, enabling the black color recording element to print at twice the density, at which the ejection orifices are aligned in each ejection orifice column, in terms of the secondary scanning movement direction of the recording element.

Ink Path Formation Assembly

Next, the ink supply path formation assembly of the above described ink supply unit will be described. In order to make it possible for the four inks within the yellow, magenta, cyan, and black ink containers, one for one, mounted in the holder portion of the ink supply unit, to be supplied to the corresponding ink supply holes of the above-described color and black recording elements, the ink supply unit in this embodiment is provided with an ink supply path formation assembly for connecting the ink containers and the ink supply holes of the recording elements.

In particular, in the case of the color recording element, each pair of the ejection orifice columns identical in the liquid they eject are symmetrically positioned with respect to the center line of the recording element in terms of the primary scanning movement direction, so that the yellow ink supplying hole can be placed at the center of the recording element, with the two magenta ink supply holes placed in a manner to sandwich the yellow ink supply hole, and the two cyan ink supply holes are placed on the outward side of the magenta ink supply holes, one for one, with respect to the center of the recording element. Therefore, the ink supply paths which connect the three ink containers to the corresponding ink supply holes, one for one, fork. In order to equalize (in terms of the properties related to ink supply performance) the nozzles which are the same in ink color, but are Uon opposite sides of the center line, the branches of each ink supply path are made equivalent to each other in properties.

Next, the structure of the above described ink supply formation assembly will be concretely described.

Figure 3:
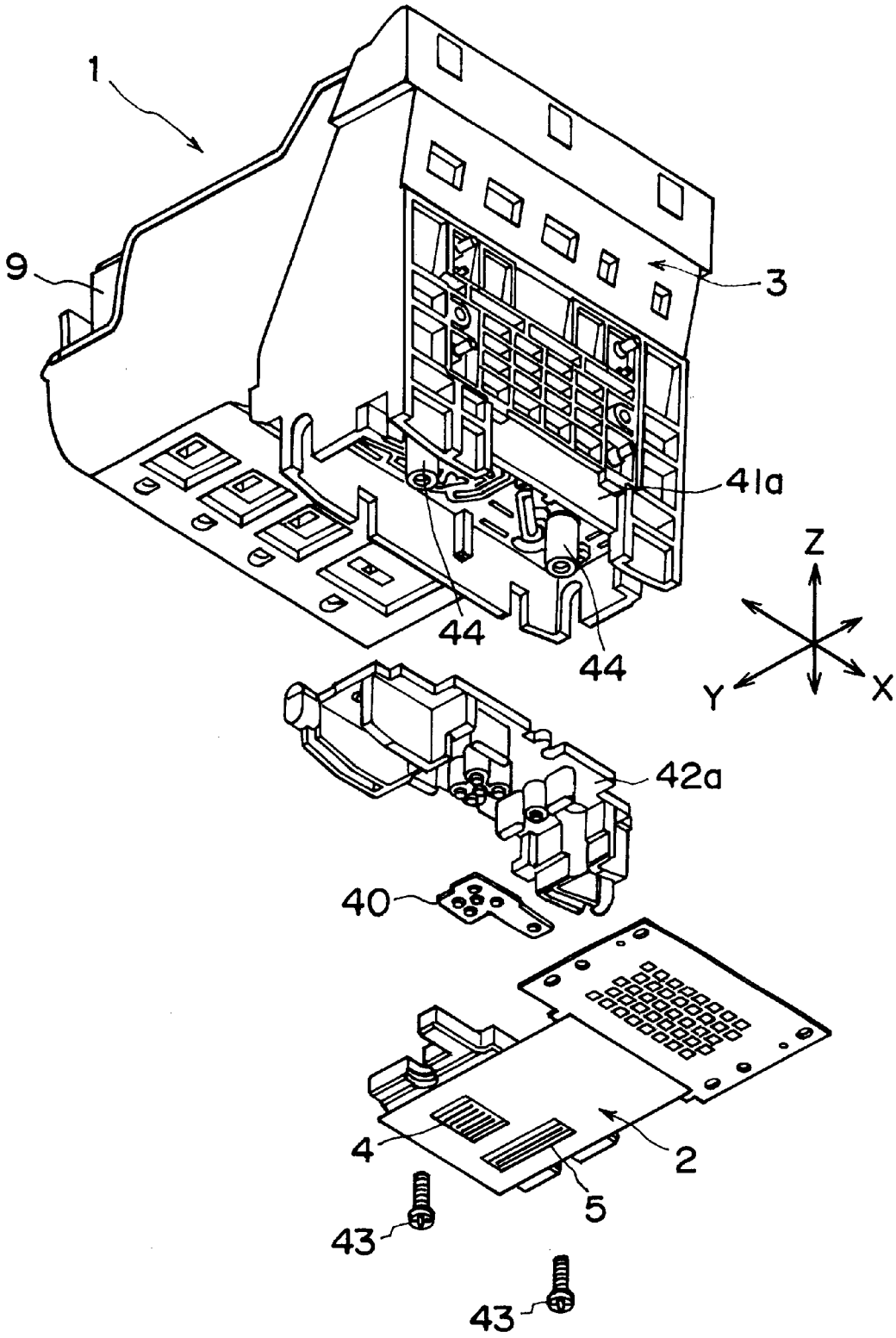
FIG. 3 is an exploded perspective view of an ink supply passage forming assembly provided in an ink supply unit of the head cartridge of FIG. 1.

FIG. 3 is a perspective view of the partially disassembled head cartridge shown in FIG. 1, for depicting the ink supply path formation assembly of the ink supply unit of the head cartridge.

As is evident from FIG. 3, the head cartridge 1 is an integrally joined combination of a recording unit 2 and an ink supplying unit 3. The ink supplying unit 3 comprises: a joint sealing member 40; an ink supply path formation assembly 42; and an ink supplying portion 41.

The joint sealing member 40 is mounted between the recording unit 2 and ink supply path formation assembly 42 to prevent ink from leaking from the joint between the ink supply paths leading to the ink containers, and the ink supply holes of the recording elements. The ink supply paths are formed by joining the ink supplying portion 41 and ink supply path formation assembly 42 by means of ultrasonic welding. The recording unit 2 and ink supplying unit 3 are joined by screwing small screws 43 into the-female threaded holes of the bosses 44 of the ink supplying portion 41, in a manner sandwiching the ink supply path formation assembly 42 and joint sealing member 40. This prevents the joint between the ink supplying portion 41 and ink supply path formation assembly 42 from being subjected to such stress as might tend to separate the two components.

Further, the use of the small screws 43 makes it easy to disassemble the head cartridge 1 for recycling or the like. Further, as the recording unit 2 and ink supplying unit 3 are joined as described above, the recording unit 2 is accurately positioned relative to the referential point of the ink supplying unit 3 with respect to the X, Y, and Z directions.

Figure 4:
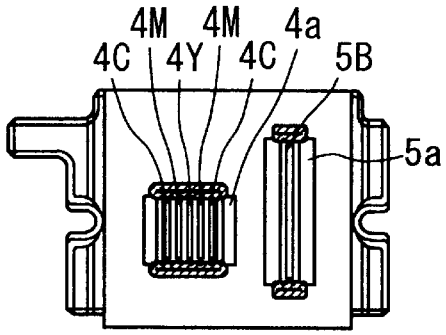
FIG. 4 is an illustration of a positional relation among the ink supply unit, the ink supply passage forming assembly and the recording head portion shown in FIG. 3.
Figure 4:
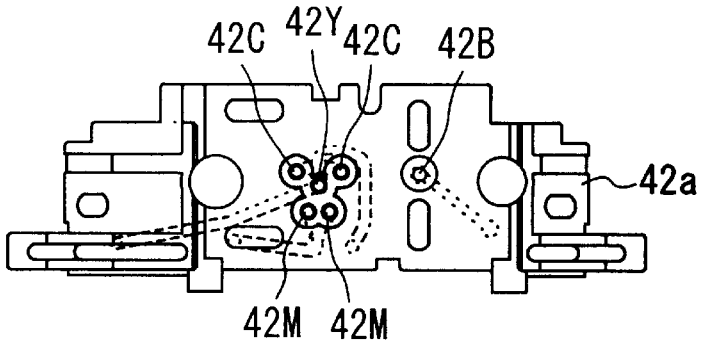
Figure 4:
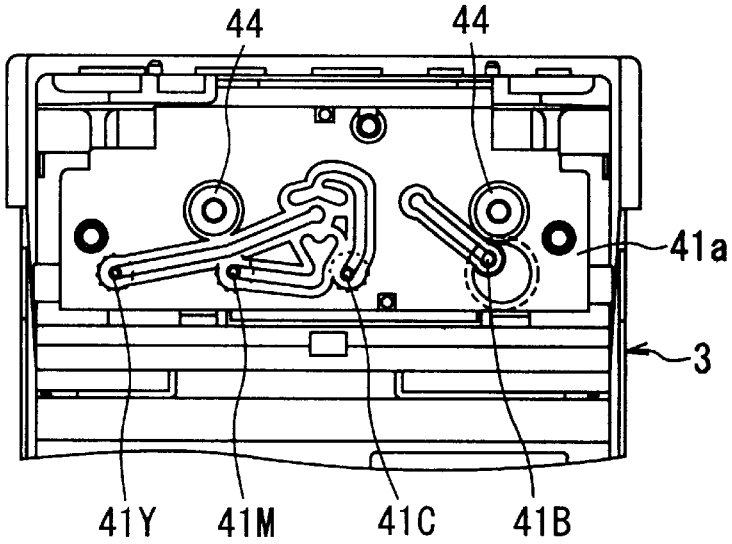

FIGS. 4(*a*), 4(*b*), and 4(*c*) are plans of the ink supplying unit, ink supply path formation assembly, and recording head portion, which are shown in FIG. 3, for showing the positional relationship among them.

Referring to FIG. 4(*a*), which is a plan of the recording head portion, the recording head portion is provided with the color recording element 4 and black recording element 5. The color recording element 4 has: a single column 4Y of yellow ink ejection orifices, which is disposed at the center of the color recording element 4; two columns 4M of magenta ink ejection orifices, which are symmetrically disposed with respect to the yellow ink ejection orifice column 4Y in a manner to sandwich the yellow ink ejection orifice column 4Y; and two columns 4C of cyan ink ejection orifices, which are outwardmost and are symmetrically disposed with respect to the yellow ink ejection orifice column 4Y, as well. The black recording element 5 has a single column 5B of black ink ejection orifices. The concrete structures of the six ejection orifice columns 4C, 4M, 4Y, 4M, 4C, and 5B are as described before with reference to FIG. 2.

On the top surface of the ink supply path formation assembly 42 shown in FIG. 4(*b*), is laid the recording head portion shown in FIG. 4(*a*).

The ink supply path formation assembly 42 is provided with ink supply holes 42C, 42M, 42Y, 42M, 42C, and 42B, the positions of which correspond to those of the ejection orifice columns 4C, 4M, 4Y, 4M, 4C, and 5B.

Evidently, the two ink supply holes 42C for the two cyan ink ejection orifice columns 4C are symmetrically disposed with respect to the yellow ink ejection orifice column 4Y, and so are the two ink supply holes 42M for the two ink ejection orifice columns 4M.

Further, on the ink supplying portion 41 of the ink supplying unit 3 shown in FIG. 4(*c*), is laid the ink supply path formation assembly 42 shown in FIG. 42(*b*). The ink supplying portion 41 is provided with ink supplying holes 41Y, 41M, 41C, and 41B, the positions of which correspond to those of the joint portions connected to the outlet openings (see reference character 50 in FIG. 1(*c*)) of the ink containers for the yellow, magenta, cyan, and black inks.

Figure 5:
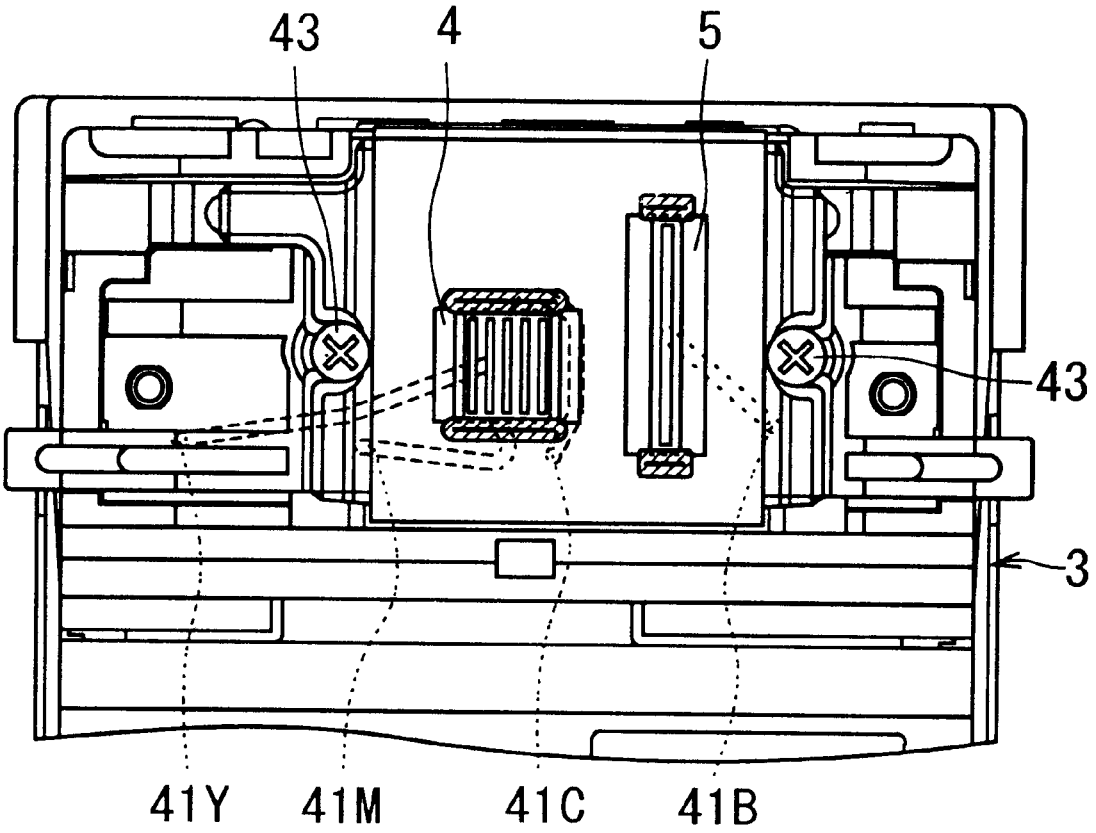
FIG. 5 is an illustration showing the parts shown in FIG. 4, assembled.

FIG. 5 is a phantom drawing of the recording head 1 after its assembly, that is, after the components shown in FIG. 4 are assembled into the recording head 1. As is evident from this drawing, in the completed ink supplying unit, the inks supplied the ink supply holes 41Y, 41M, 41C, and 41B which correspond to the joint portions (unshown) connected to the ink outlet openings 50 of the yellow, magenta, cyan, and black inks, are supplied to the six ejection orifice columns 4C, 4M, 4Y, 4M, 4C, and 5B of the recording head portion, through the ink supply paths (portions outlined with dotted lines in FIG. 5) formed by the joining of the above described ink supplying portion 41 and ink supply path formation assembly 42.

Incidentally, only one ink supply path is provided between the ink supply hole 41Y, which corresponds to the joint portion for the yellow ink container, and the yellow ink ejection orifice column 4Y, and also, only one ink supply path is provided between the ink supply hole 41B, which corresponds to the joint portion for the black ink container, and the black ink ejection orifice column 4B. The ink supply path extending from the ink supply hole 41C corresponding to the joint portion for the cyan ink container, to the two identical cyan ink ejection orifice columns 4C forks into two branches at a predetermined point, and so does the ink supply path for the magenta ink.

Further, the above described ink supply paths are in the interface portion sandwiched between the ink supplying portion 41 and ink supply path formation assembly 42. The ink supply paths, which each fork into two or more branches (two in this embodiment) which connect to the ejection orifice columns identical in ink color, are symmetrically shaped with respect to their center lines of the recording element in terms of the scanning movement direction of the recording head 1 (with respect to the center line of the yellow ink ejection orifice column 4Y, in this embodiment); the corresponding branches of each ink supply path are the same in length (FIGS. 4(*b*) and 4(*c*)).

With the provision of the above described structural arrangement, each pair of ejection orifice columns identical in ink color can be made virtually the same in the resistance (pressure loss, which is determined by the length of the ink supply path, cross-sectional size of the ink supply path, maximum ink velocity, ink viscosity, and the like) which occurs against the ink flow as ink flows from an ink container to the pair of ejection orifice columns. Therefore, each pair of ejection orifice columns identical in ink color can be made virtually the same in the properties related to ink ejection, and bubble removal from the ink supply path. To which point of each ejection orifice column the corresponding ink supply path is connected, affects the degree of difficulty with which ink is prevented from being insufficiently supplied, and the degree of difficulty with which bubbles remaining in the ink supply path is removed. Therefore, even in a case other than this embodiment, it is to be desired that the ink supply paths should be disposed in the adjacencies of the center of the ejection orifice column array. However, if the ink supply paths are positioned in a certain way, it is difficult to place the ink supply paths in the adjacencies of the center of the ejection orifice column array. In such a case, in order to minimize the difference in ejection performance as between when the recording head is moved in the scanning manner in one direction and when the recording head is moved in the scanning manner in the other direction, each pair of ejection orifice columns identical in ink color are made the same as to the position of the ink supply hole relative to the ejection orifice column, so that the pair of ejection orifice columns become symmetrical to each other with respect to the aforementioned center line of the recording head, even in terms of the position of the ink supply hole.

Provided that the cross-sectional shape of the ink supply path is the same across its entire range, the pressure which is lost between the joint portion for each ink container and the corresponding ejection orifice column is approximated with the use of the sum of the length of the portion of the ink supply path before the forking point, and the quotient obtained by dividing the length of the portion of the ink supply path after the forking point by the number of the branches.

Therefore, the ink supply paths are positioned in a manner to make the difference in the above-described length as small as possible.

When it is difficult to equalize the ink supply paths in the pressure loss by adjusting the length, the pressure loss which occurs within the portion of the ink path leading to each ejection orifice column can be adjusted by differentiating, in cross section, a portion, or the entire range, of specific ink supply paths, from those of the other ink supply paths.

Figure 13:
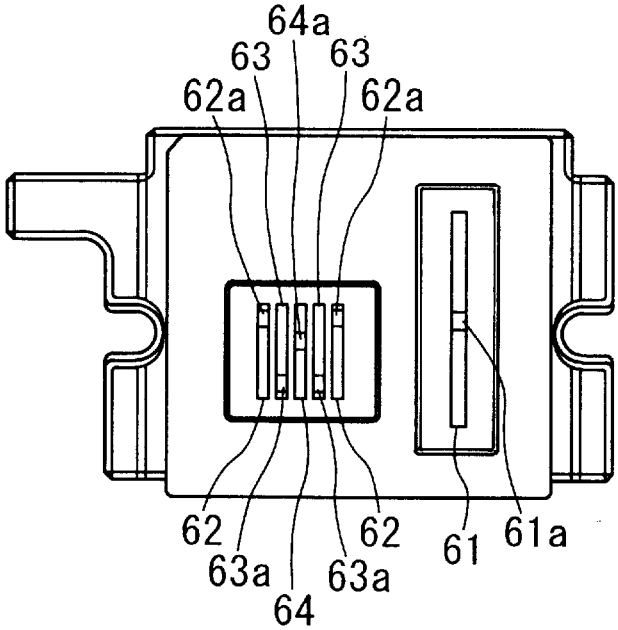
FIG. 13 is an illustration of a support substrate for color recording elements and black recording elements with such elements omitted, in FIG. 4(*a*).

FIG. 13 is a plan view of the actual substrate portion of the recording head portion that is, the recording head portion shown in FIG. 4(*a*) from which the color recording element and black recording element have been removed. In this drawing, reference character 61 designates an ink supply groove correspondent to the black liquid chamber of the black recording element. The groove 61 is connected to a through hole 61*a* which is in the substrate portion of the recording head portion and is to be connected to the black ink supply hole 42B shown in FIG. 4(*b*). Similarly, reference characters 62, 63, and 64 designate ink supply grooves correspondent to the cyan, magenta, and yellow ink chambers of the color recording element, and referential codes 62*a*, 63*a*, and 64*a* designate through holes which are also in the substrate portion of the recording head portion and are to be connected to the cyan, magenta, and yellow ink supply holes 42C, 42M, and 42Y shown in FIG. 4(*b*). This type of correspondence also obtains in the other preferred embodiments of the present invention.

Figure 14:
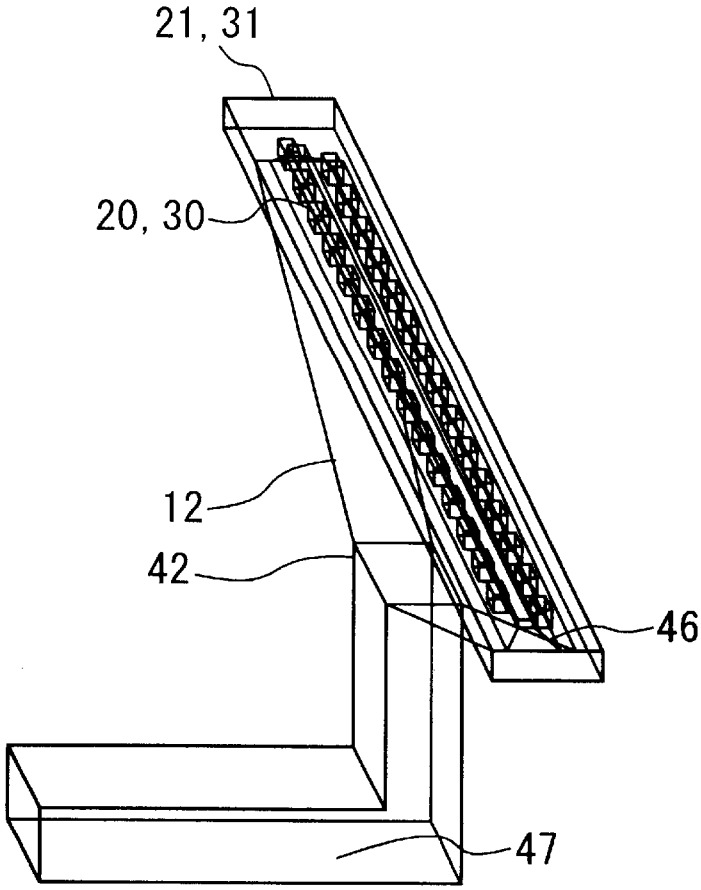
FIG. 14 is a perspective view of an ink passage from an ejection outlet array to the ink supply passage in FIG. 4.
Figure 15:
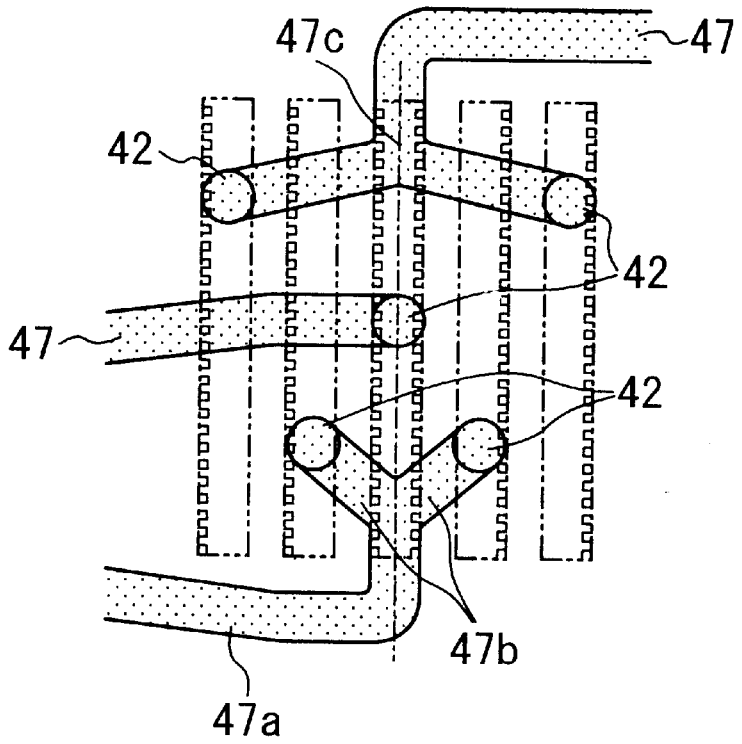
FIG. 15 is an enlarged view of a neighborhood of a color ejection portion of FIG. 4 as seen from the support substrate.
Figure 16:
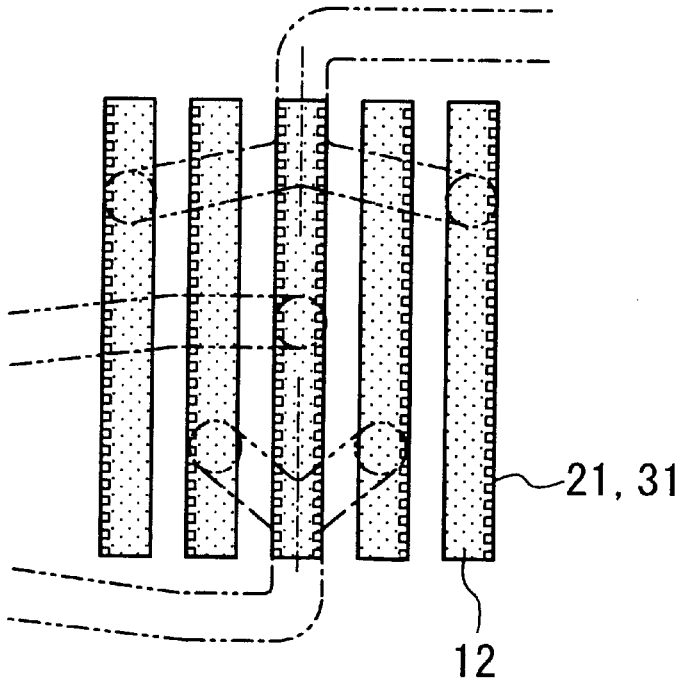
FIG. 16 is an enlarged view of a neighborhood of the color ejection portion of FIG. 4 as seen from the ejection outlet side.

To described this embodiment in more detail, the structure for supplying ink to an ejection orifice column for ejecting ink of a given color is generally as shown in FIG. 14. The ink supplied from an ink container (unshown) flows through an ink supply path 47, and is introduced into a supply groove 12, which is a common liquid chamber, through a supply path joint 42. Then, it is further caused to flow from the common liquid chamber 12 to the ejection orifice column group 20 and 30. The structure for supplying ink to a plurality of ejection orifice columns which are the same in the color of the ink they eject, is as shown in FIG. 15. The supply path 47 comprises a common supply path 47*a* through which ink is flowed out of an ink container, and a plurality of dedicated supply paths 47*b*, into which the common supply path 47*a* fork at a forking point 47*c*, and the number of which corresponds to the number of the ejection orifice columns to which ink is supplied. The ink supplying structure past the supply path joint 42 between the dedicated supply path and ejection orifice column is as shown in FIG. 16. In other words, it is the same as the above described ordinary structure. That is, ink is introduced into the common groove 12 through the supply path joint 42, and then is supplied to the ejection orifices 11 of the ejection orifice column group 20 and 30 by way of the common liquid chamber 12. In this embodiment, the black ink ejection orifice column of the black recording element independent from the color recording element, and the yellow ink ejection orifice column of the color recording element, which is located at the center of the color recording element in which the color ink ejection orifice columns are symmetrically disposed with respect to the yellow ink ejection orifice column, are similar in their supply path structure to a conventional recording head. However, in the case of the supply path structure for the cyan and magenta ink ejection orifice columns, the common supply paths 47*a* each fork into two dedicated supply paths 47*b* which lead to two separate ejection orifice columns, one for one. Further, the two supply path joints, that is, one between one of the dedicated supply paths 47*a* and corresponding ejection orifice column, and the other between the other dedicated supply path 47*a* and corresponding ejection orifice column, are symmetrically positioned with respect to the line connecting the two forking points 47*c*, and the supply path joint 42 between the non-forking supply path 47*a* and the corresponding ejection orifice column.

Equalizing, in volume, pressure loss, and the like, the plurality of dedicated supply paths for supplying the plurality of ejection orifice columns, one for one, which are the same in the ink they eject, prevents the plurality of the ejection orifice columns from becoming different from each other in the properties regarding the removal of the bubbles remaining within the supply paths, and ink ejection performance. As a result, differences do not occur between the manner in which an image is recorded while a recording head is moving in one direction, and the manner in which an image is recorded while the recording head is moving in the other direction.

Further, the recording head can be efficiently restored in recording performance.

Further, equalizing the dedicated supply paths in the angle at which they fork from the common supply path at the forking point, makes it possible to equalize the dedicated supply paths, in the effects of the inertia of the flowing ink.

Further, symmetrically positioning the dedicated supply path portions with respect to the line perpendicular to the line connecting the two joints between the dedicated supply path portions and corresponding ejection orifice columns, makes it easier to equalize the dedicated supply path portions in pressure loss or volume.

Figure 17:
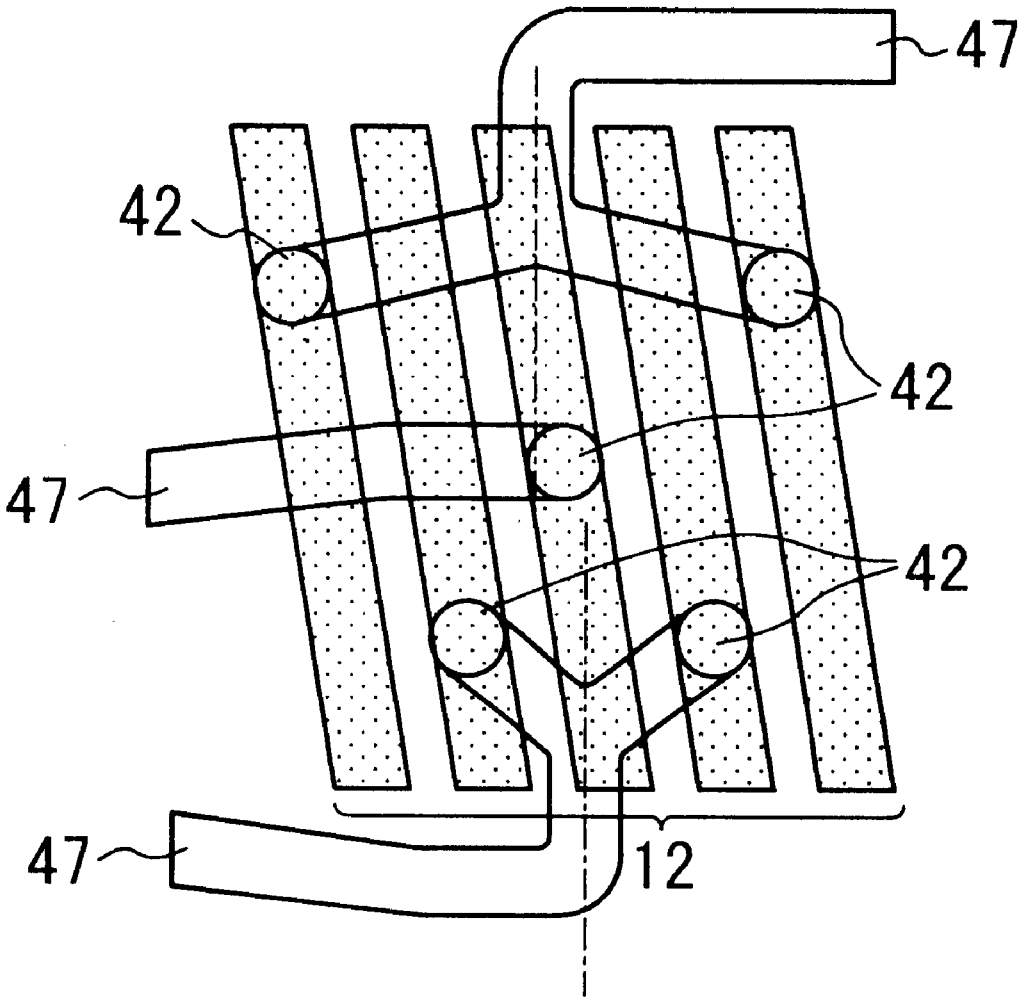
FIG. 17 is an enlarged view of a modified example of the device shown in FIG. 16.

Referring to FIG. 17, even if the angles of the ejection orifice columns with reference to the direction of the scanning movement of the recording head are not 90°, and therefore, the pairs of ejection orifice columns are different in the line with respect to which each pair of ejection orifice columns are symmetrically positioned, the employment of the above-described structural arrangement makes it possible to provide a head cartridge which always records in the same manner regardless of the direction in which it is making the scanning movement, and is efficient in recovery.

Embodiment 2

This embodiment is the same in the recording unit structure as the above described first embodiment, but is different from the first embodiment, in the ink supply path structure in the ink supply unit. Thus, only the structure of the ink supply path, which is different from that in the first embodiment, will be described.

Figure 6:
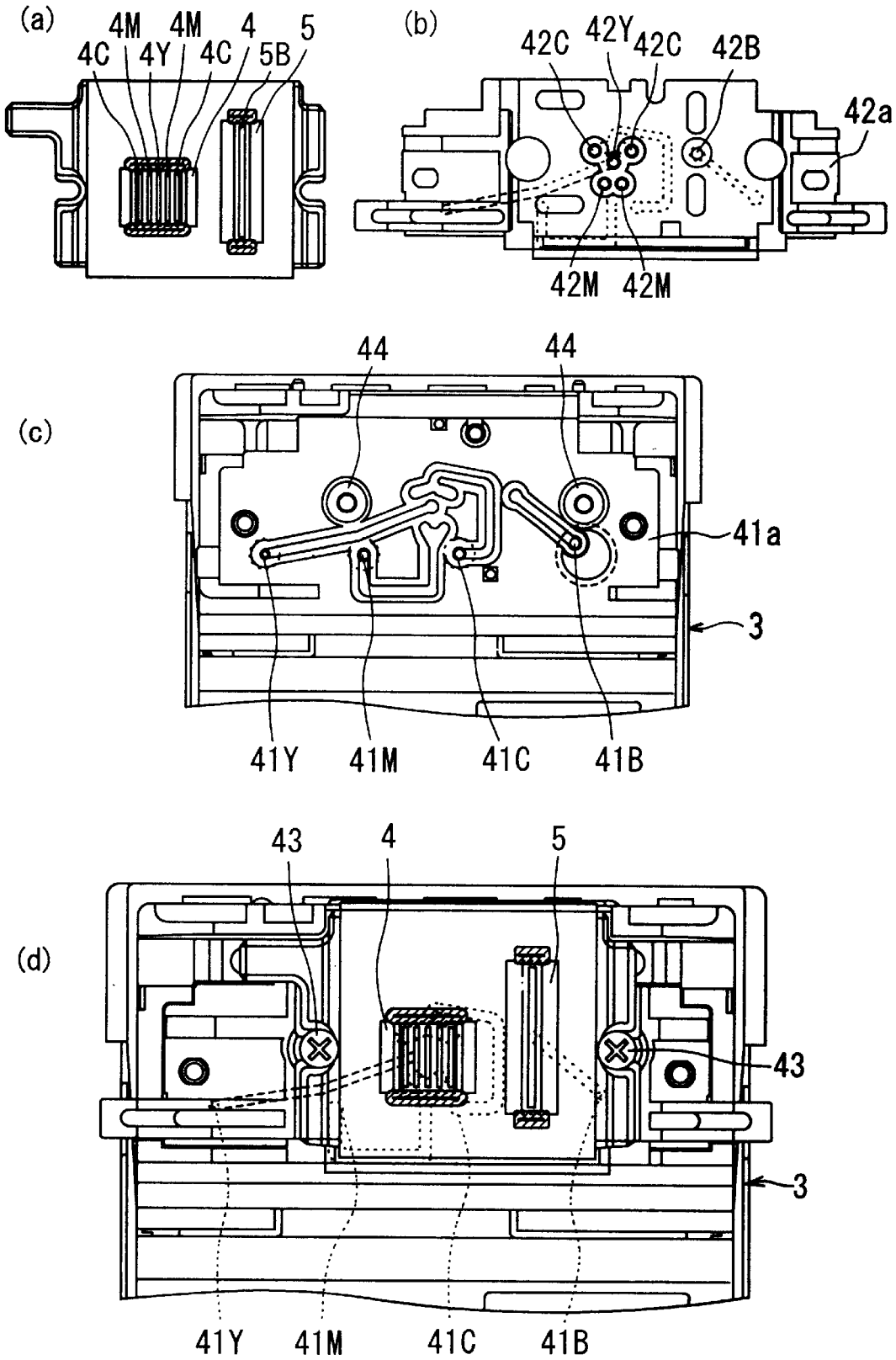
FIG. 6(*a*) and FIG. 6(*c*) are illustrations of a positional relationship among the ink supply unit, the ink supply passage forming assembly and the recording head portion.

FIGS. 6(*a*)–6(*c*) are plan views of the ink supplying unit, ink supply path formation assembly, and recording head, shown in FIG. 3, and are for showing the positional relationship among the components and portions therein. FIG. 6(*d*) is a phantom view of the recording head completed by assembling the members shown in FIGS. 6(*a*)–6(*c*).

As shown in these drawings, in the completed ink supplying unit 3, the inks supplied from the ink supply holes 41Y, 41M, 41C, and 41B which correspond to the joint portions (not shown) connected to the ink outlet openings 50 of the yellow, magenta, cyan, and black ink containers, are supplied to the six ejection orifice columns 4C, 4M, 4Y, 4M, 4C, and 5B of the recording head portion, through the ink supply paths (portions outlined with dotted lines in FIG. 6) formed by the ink supplying portion 41 a and ink supply path formation assembly 42*a*.

Incidentally, only one ink supply path is provided between the ink supply hole 41Y, which corresponds to the joint portion for the yellow ink container, and the yellow ink ejection orifice column 4Y, and also, only one ink supply path is provided between the ink supply hole 41B, which corresponds to the joint portion for the black ink container, and the black ink ejection orifice column 4B. The ink supply path from the ink supply hole 41C corresponding to the joint portion for the cyan ink container, to the two identical cyan ink ejection orifice columns 4C forks into two branches at a predetermined point, and so does the ink supply path for the magenta ink.

Further, the above described ink supply paths are in the interface portion sandwiched between the ink supplying portion 41*a* and ink supply path formation assembly 42*a*. The ink supply paths, which fork into two or more branches (two in this embodiment) which connect to the ejection orifice columns identical in ink color, are symmetrically shaped in this sandwiched portion (with respect to the center line of the yellow ink ejection orifice column 4Y, in this embodiment); the corresponding branches of each ink supply path are the same in length (FIGS. 6(*b*) and 6(*c*)).

Further, unlike the first embodiment, the ink supply paths for cyan, magenta, and yellow inks, which are close to each other in the properties of the liquid which flows through them, are equalized in the length of the common portion of the ink supply path, that is, the portion of the ink supply path before the forking point (FIGS. 6(*b*), 6(*c*), and 6(*d*)).

With the provision of the above-described structural arrangement, not only can each pair of ejection orifice columns identical in ink color be made virtually the same in the resistance (pressure loss, the amount of which is determined by the length of the ink supply path, cross-sectional size of the ink supply path, maximum ink velocity, ink viscosity, and the like) which occurs against the ink flow as ink flows from an ink container to the pair of ejection orifice columns, but also can the ejection orifice columns which are close to each other in liquid properties. Therefore, not only can each pair of ejection orifice columns identical in ink color can be made virtually the same in ink ejection performance, and efficiency with which bubbles are removed from the ink supply path, but also can the ejection orifice columns which are close to each other in the liquid properties.

Embodiment 3

This embodiment is also the same in the recording unit structure as the above-described first embodiment, but is different from the first embodiment, in the ink supply path structure in the ink supply unit. Thus, only the structure of the ink supply path, which is different from that in the first embodiment, will be described.

Figure 7:
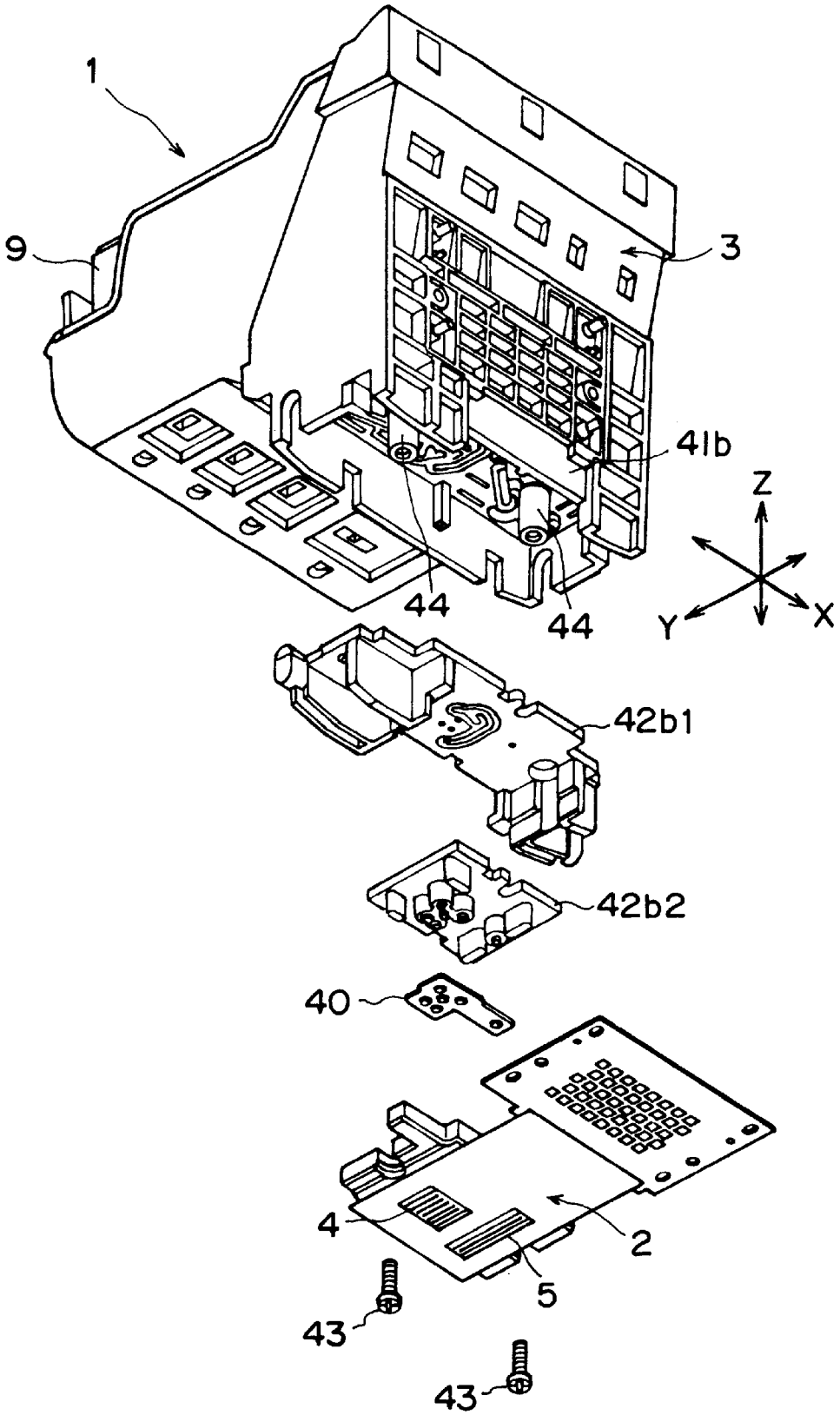
FIG. 7 is an exploded perspective view of an ink supply passage forming assembly provided in an ink supply unit of the head cartridge of FIG. 1.

FIG. 7 is a perspective view of the partially disassembled head cartridge shown in FIG. 1, for depicting the ink supply path formation assembly of the ink supply unit of the head cartridge.

As is evident from FIG. 7, the head cartridge 1 is an integrally joined combination of a recording unit 2 and an ink supplying unit 3. The ink supplying unit 3 comprises: the joint sealing member 40; ink supply path formation assemblies 42*b*1 and 42*b*2; and ink supplying portion 41.

The joint sealing member 40 is mounted between the recording unit 2 and ink supply path formation assembly 42 to prevent ink from leaking from the joint between the ink supply paths extending from the ink containers to the ink supply holes of the recording elements. The ink supply paths are formed by joining the ink supplying portion 41*b* and ink supply path formation assemblies 42*b*1 and 42*b*2 by means of ultrasonic welding.

The recording unit 2 and ink supplying unit 3 are joined by screwing small screws 43 into the screw hole bosses 44 of the ink supplying portion 41*b*, in a manner sandwiching the ink supply path formation assemblies 42*b*1 and 42*b*2 and joint sealing member 40. This prevents the joints between the ink supplying portion 41*b* and ink supply path formation assemblies 42*b*1 and 42*b*2 from being subjected to such stress as might separate the three components. In addition, the usage of the small screws 43 makes it easy to disassemble the head cartridge 1. Further, as the recording unit 2 and ink supplying unit 3 are joined as described above, the recording unit 2 is accurately positioned relative to the referential point of the ink supplying unit 3 with respect to the X, Y, and Z directions.

Figure 8:
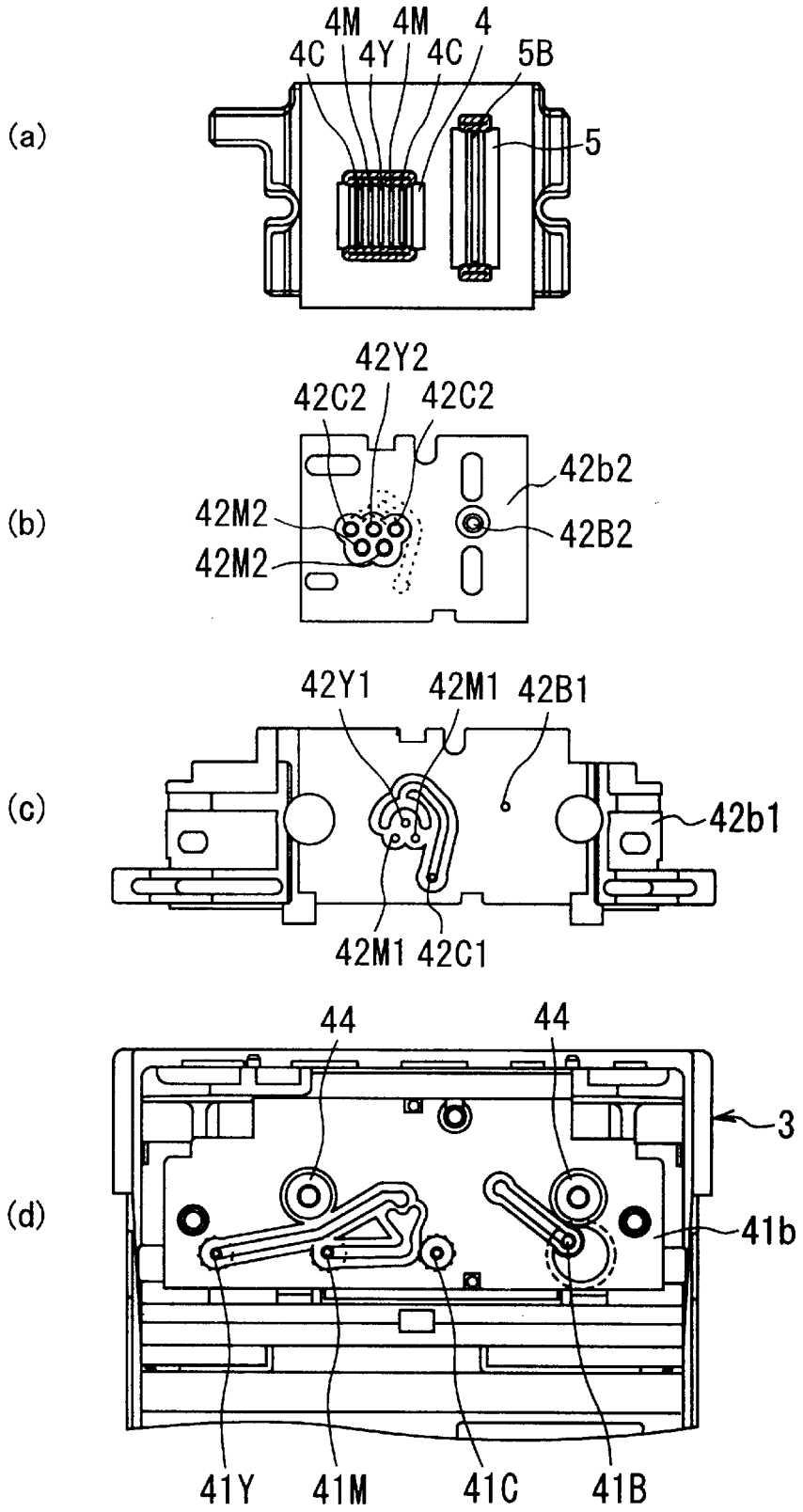
FIG. 8 is an illustration of a positional relation among the ink supply unit, the ink supply passage forming assembly and the recording head portion shown in FIG. 7.

FIGS. 8(*a*)–8(*d*) are plan views of the ink supplying unit, ink supply path formation assemblies, and recording head portion, which are shown in FIG. 7, for showing the positional relationship among them.

Referring to FIG. 8(*a*), which is a plan view of the recording head portion, the recording head portion is provided with the color recording element 4 and black recording element 5. The color recording element 4 has: the single column 4Y of yellow ink ejection orifices, which is disposed at the center of the color recording element 4; two columns 4M of magenta ink ejection orifices, which are symmetrically disposed with respect to the yellow ink ejection orifice column 4Y in a manner to sandwich the yellow ink ejection orifice column 4Y; and two columns 4C of cyan ink ejection orifices, which are most outwardly and symmetrically disposed with respect to also the yellow ink ejection orifice column 4Y. The black recording element 5 has the single column 5B of black ink ejection orifices. The concrete structures of the six ejection orifice columns 4C, 4M, 4Y, 4M, 4C, and 5B are as described before with reference to FIG. 2.

On the top surface of the ink supply path formation assembly 42*b*2 shown in FIG. 8(*b*), is laid the recording head portion shown in FIG. 8(*a*).

The ink supply path formation assembly 42*b*2 is provided with ink supply holes 42C2, 42M2, 42Y2, 42M2; 42C2, and 42B2, the positions of which correspond to those of the six ejection orifice columns 4C, 4M, 4Y, 4M, 4C, and 5B. The two ink supply holes 42C2 for the two cyan ink ejection orifice columns 4C are symmetrically disposed with respect to the center line of the yellow ink supply hole 42Y2, and so are the two ink supply holes 42M2 for the two ink ejection orifice columns 4M.

Further, on the ink supply path formation assembly 42*b*1 shown in FIG. 8(*c*), is laid the ink supply path formation assembly 42*b*2 shown in FIG. 8(*b*). The ink supply path formation assembly 42*b*1 is provided with ink supply openings 42M1, 42Y1, 42M1, and 42B1, the positions of which correspond to those of the ink supply holes 42M2, 42Y2, 42M2, and 42B2 of the ink supply path formation assembly 42*b*2. Further, the ink supply path formation assembly 42*b*1 is provided with a magenta cyan ink supplying hole 42, the position of which corresponds to that of the ink supply hole 41C shown in FIG. 8(*d*).

Further, in the ink supplying portion 41*b* of the ink supplying unit 3 shown in FIG. 8(*d*), is mounted the ink supply path formation assembly 42*b*1 shown in, FIG. 8(*c*). The ink supplying portion 41*b* is provided with ink supply holes 41Y, 41M, 41C, and 41B, the positions of which correspond to those of the joint portions which connect to the ink outlet openings 50 of the ink containers for Y, M, C, and B inks, one for one.

Figure 9:
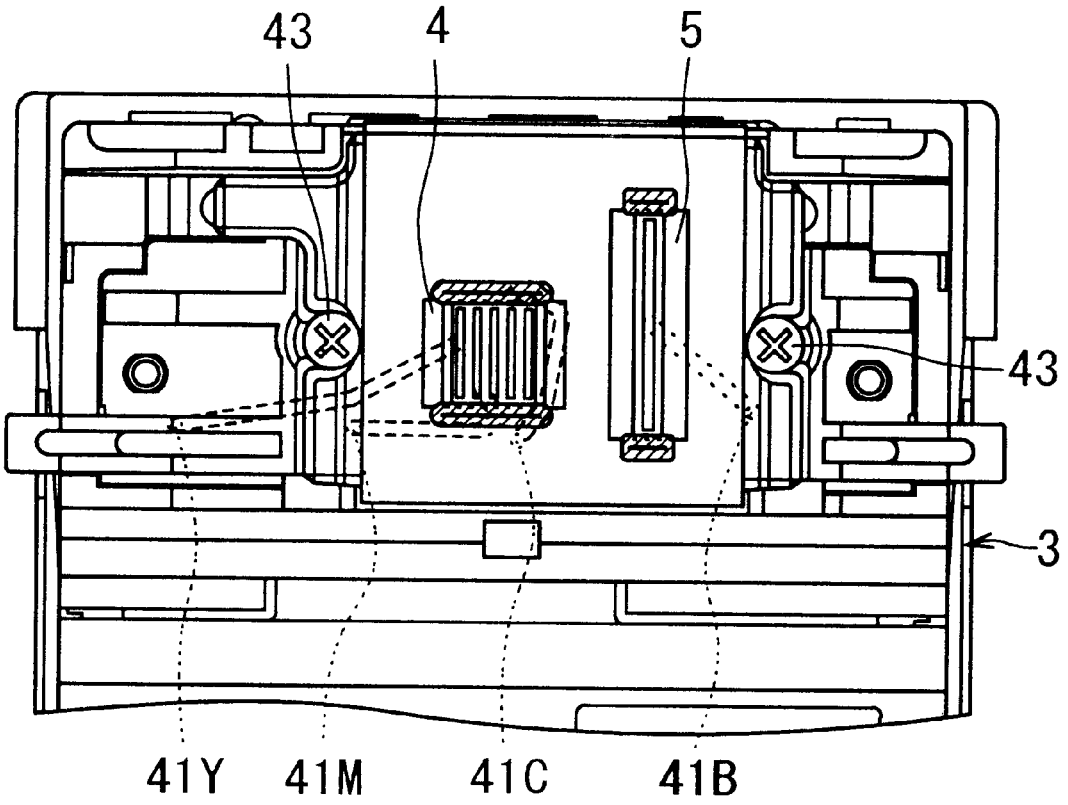
FIG. 9 is an illustration showing the parts shown in FIG. 8, assembled.

FIG. 9 is a phantom drawing of the recording head 1 after its assembly, that is, after the components shown in FIG. 8 are put together.

As is evident from this drawing, in the completed ink supplying unit, the inks supplied from the ink supply holes 41Y, 41M, 41C, and 41B which correspond to the joint portions (not shown) connected to the ink outlet openings 50 of the yellow, magenta, cyan, and black ink containers, are supplied to the six ejection orifice columns 4C, 4M, 4Y, 4M, 4C, and 5B of the recording head portion, through the ink supply paths (portions outlined with dotted lines in FIG. 9) formed by the above-described ink supplying portion 41*b* and ink supply path formation assemblies 42*b*1 and 42*b*2.

Incidentally, only one ink supply path is provided between the ink supply hole 41Y, which corresponds to the joint portion for the yellow ink container, and the yellow ink ejection orifice column 4Y, and also, only one ink supply path is provided between the ink supply hole 41B, which corresponds to the joint portion for the black ink container, and the black ink ejection orifice column 4H. The ink supply path extending from the ink supply hole 41C corresponding to the joint portion for the cyan ink container, to the two identical cyan ink ejection orifice columns 4C forks into two branches at a predetermined point, and so does the ink supply path for the magenta ink.

Further, the above described ink supply paths for the yellow, black, and magenta inks are in the interface portion sandwiched between the ink supplying portion 41*b*1 and ink supply path formation assembly 42*b*1, and the ink supply path for the cyan ink is in the interface portion sandwiched between the ink supply path formation assemblies 42*b*1 and 42*b*2. The ink supply paths, which each fork into two or more branches (two in this embodiment) which connect to the ejection orifice columns identical in ink color, are symmetrically shaped in the above described interface portions (with respect to the center line of the yellow ink ejection orifice column 4Y, in this embodiment); the corresponding branches of each ink supply path are the same in length (FIGS. 8(*b*), 8(*c*), and 8(*d*)). With the provision of the above-described structural arrangement, each pair of ejection orifice columns identical in ink color can be made virtually the same in the resistance which occurs against the ink flow as ink flows from an ink container to the pair of ejection orifice columns. Therefore, each pair of ejection orifice columns identical in ink color can be made virtually the same in the properties related to ink ejection, and bubble removal from the ink supply path.

Further, in this embodiment, the plurality of ink supply paths, which must each be made to fork into two groups of branches that connect to two groups of ejection orifices columns, one for one, are divided into a plurality groups, and the plurality of groups are made different in the interface portions among the various components of the recording head, in which they are positioned. Therefore, more latitude is afforded in terms of ink supply path layout.

However, in this structure, the ink supply path formation assemblies 42*b*1 and 42*b*2 are laid on top of the ink supplying portion 41*b* of the ink supplying unit 3. Therefore, there is a possibility that the ink supply holes (42C2, 42M2, 42Y2, 42M2, 42C2, and 42B2) become different in height due to the variance in the accuracy with which the ink supplying portion 41*b* and ink path formation assemblies 42*b*1 and 42*b*2 are joined. Therefore, compensation is made for the aforementioned variance in the ink supply hole height by adjusting the amount by which the joint sealing member 40 is compressed against the recording unit 2 and ink path formation assembly 42*b*2, so that all the recording head will be uniform in the state of the joint between the ink supply path extending from the ink container, and the ink supply hole of the recording element.

Embodiment 4

This embodiment is also the same in the recording unit structure as the above described first embodiment, but is different from the first embodiment, in the ink supply path structure in the ink supply unit. Thus, only the structure of the ink supply path, which is different from that in the first embodiment, will be described.

Figure 10:
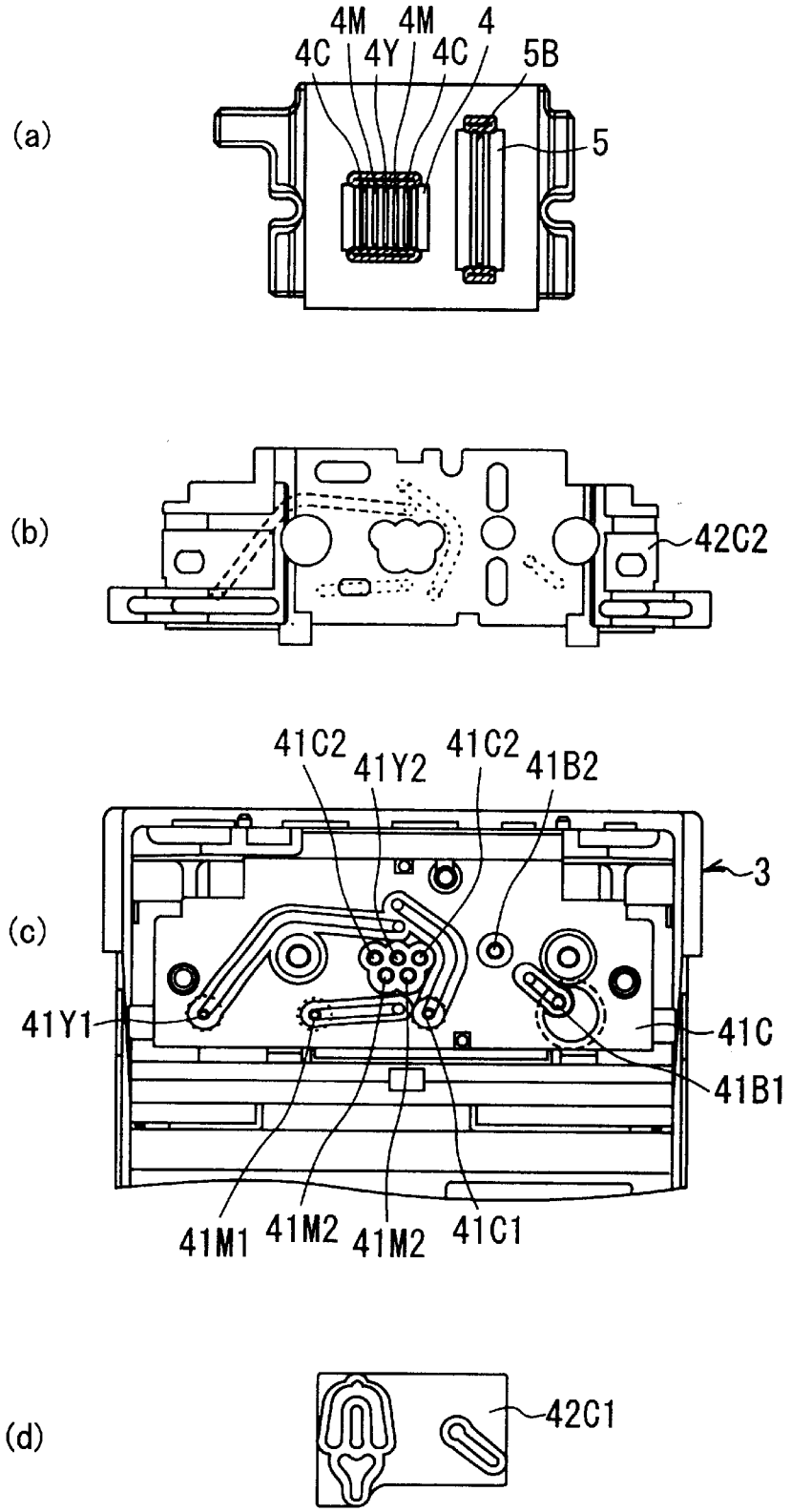
FIG. 10 is an illustration of an ink supply unit, an ink supply passage formation assembly and a recording head portion constituting the head cartridge shown in FIG. 1.

FIGS. 10(*a*)–10(*d*) are plan views of the ink supplying unit, ink supply path formation assembly, and recording head portion, which are shown in FIG. 1, for showing the positional relationship among them.

Referring to FIG. 10(*a*), which is a plan view of the recording head portion, the recording head portion is provided with the color recording element 4 and black recording element 5. The color recording element 4 has: the single column 4Y of yellow ink ejection orifices, which is disposed at the center of the color recording element 4; two columns 4M of magenta ink ejection orifices, which are symmetrically disposed with respect to the yellow ink ejection orifice column 4Y in a manner to sandwich the yellow ink ejection orifice column 4Y; and two columns 4C of cyan ink ejection orifices, which are outwardmost and are symmetrically disposed with respect to the yellow ink ejection orifice column 4Y as well. The black recording element 5 has the single column 5B of black ink ejection orifices. The concrete structures of the six ejection orifice columns 4C, 4M, 4Y, 4M, 4C, and 5B are as described before with reference to FIG. 2.

On the top surface of the ink supply path formation assembly 42*b*2 shown in FIG. 10(*b*), is laid the recording head portion shown in FIG. 10(*a*).

Further, on top of the ink supplying portion 42*c* shown in FIG. 10(*c*), is laid the ink supply path formation assembly 42*c*1 shown in FIG. 10(*d*), Further, in the ink supplying portion 41*c* of the ink supplying unit 3 shown in FIG. 10(*c*), is mounted the ink supply path formation assembly 42*c*2 shown in FIG. 10(*b*). The ink supplying portion 41*c* is provided with ink supply holes 41Y, 41M, 41C, and 41B, the positions of which correspond to those of the joint portions which connect to the ink outlet openings 50 of the ink containers for Y, M, C, and B inks, one for one.

In addition, the ink supplying portion 42*c* is provided with ink supply holes 41C2, 41M2, 41Y2, 41M2, 41C2, and 41B2, the positions of which correspond to those of the ejection orifice columns 4C, 4M, 4Y, 4M, 4C, and 5B. The two cyan ink supply holes 41C2 are symmetrically positioned with respect to the center line of the yellow ink supply hole 41Y2, and so are the two magenta ink supply holes 41M2.

Figure 11:
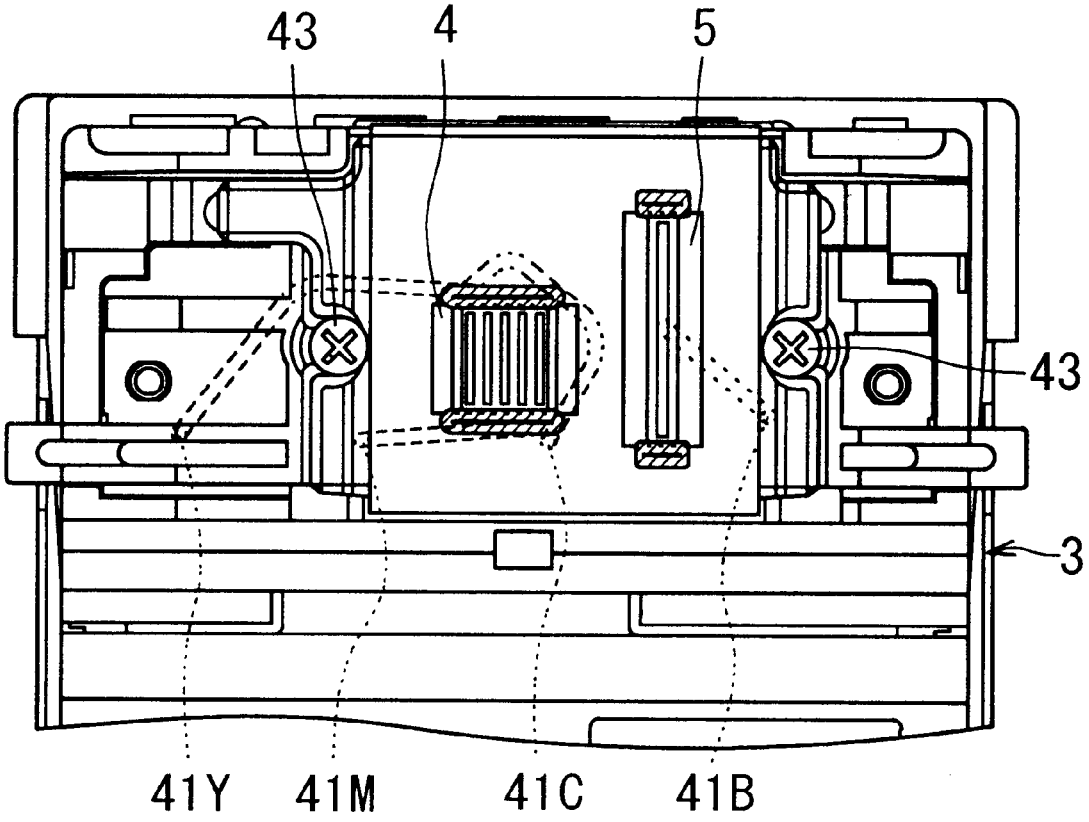
FIG. 11 is an illustration showing the parts shown in FIG. 9, assembled.

FIG. 11 is a phantom drawing of the recording head 1 after its assembly, that is, after the components shown in FIG. 10 are put together.

As is evident from this drawing, in the completed ink supplying unit, the inks supplied from the ink supply holes 41Y1, 41M1, 41C1, and 41B1 which correspond to the joint portions (not shown) connected to the ink outlet openings of the yellow, magenta, cyan, and black ink containers, are supplied to the six ejection orifice columns 4C, 4M, 4Y, 4M, 4C, and 5B of the recording head portion, from the ink supply holes 41C2, 41M2, 41M2, 41M2, 41C2, and 41B2 on the ink supplying portion 41, by way of the ink supply paths (portions outlined with dotted lines in FIG. 11) formed by the above described ink supplying portion 41*c* and ink supply path formation assemblies 42*c*1 and 42*c*2.

Incidentally, only one ink supply path is provided between the ink supply hole 41Y, which corresponds to the joint portion for the yellow ink container, and the yellow ink ejection orifice column 4Y, and also, only one ink supply path is provided between the ink supply hole 41H, which corresponds to the joint portion for the black ink container, and the black ink ejection orifice column 4H. The ink supply path extending from the ink supply hole 41C1 corresponding to the joint portion of the cyan ink container, to the two identical cyan ink ejection orifice columns 4C forks into two branches at a predetermined point, and so does the ink supply path for the magenta ink.

Further, the above described ink supply paths are in the interface portion sandwiched between the ink supplying portion 41C and ink supply path formation-assembly 42*c*1, and the interface portion sandwiched between the ink supplying portion 41C and the ink path formation assembly 42*c*2. The ink supply paths, which each fork into two or more branches (two in this embodiment) which connect to the ejection orifice columns identical in ink color, are symmetrically shaped in the above-described two interface portions (with respect to the center line of the yellow ink ejection orifice column 4Y, in this embodiment), the corresponding branches of each ink supply path are the same in length (FIG. 10(*c*)). With the provision of the above-described structural arrangement, each pair of ejection orifice columns identical in ink color can be made virtually the same in the resistance which occurs against the ink flow as ink flows from an ink container to the pair of ejection orifice columns. Therefore, each pair of ejection orifice columns identical in ink color can be made virtually the same in the properties related to ink ejection, and in bubble removal from the ink supply path.

Further, in this embodiment, the plurality of ink supply paths extending from the joint-portions for the ink containers to the ink supply holes of the ejection orifice columns are divided into a plurality groups, and the plurality of groups are made different in the interface portions among the various components of the recording head; in which they are positioned. Therefore, more latitude is afforded in terms of ink supply path layout.

However,in this structure, the ink supply holes 41C2, 41M2, 41Y2, 41M2, 41C2, and 41B2, which are to be connected to the ink supply holes of the ejection orifice columns 4C, 4M, 4Y, 4M, 4C, and 5B are in the ink supplying portion 41*c*, unlike the structure in the third embodiment.

Therefore, the heights of the ink supply holes are determined by the measurements of the ink supplying portion 41*c* alone, eliminating the variance in the amount by which the joint sealing member is compressed when the ink supplying unit 41*c* is joined with the recording unit 2.

Other Embodiments

Figure 12:
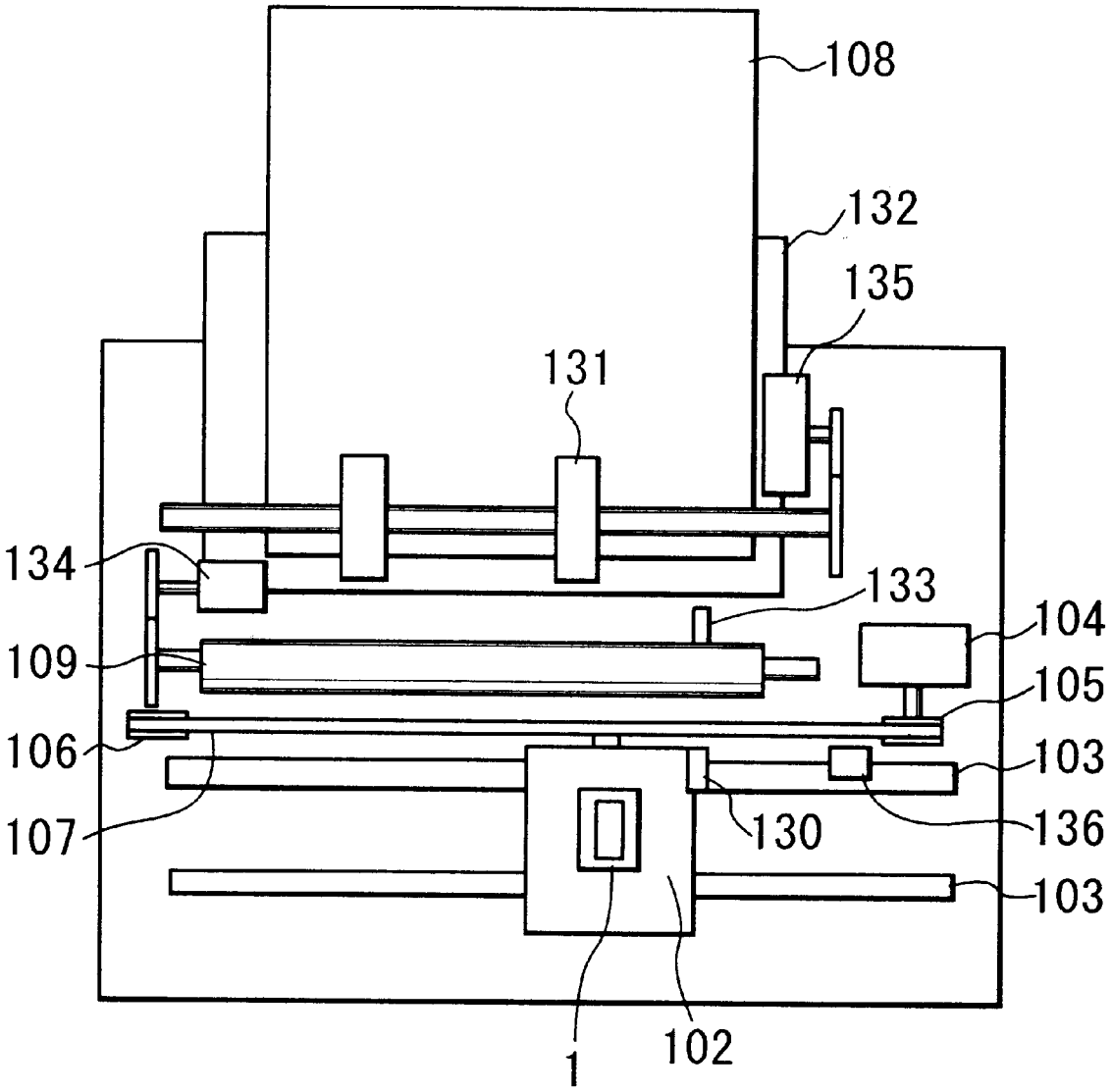
FIG. 12 is an illustration of an example of a recording device on which a liquid ejection recording head according to the present invention can be carried.

Lastly, an example of a liquid ejection recording apparatus in which a cartridge type recording head such as the one described above is mountable will be described. FIG. 12 is a rough plan view of an example of a recording apparatus in which a liquid ejection recording head in accordance with the present invention is mountable.

In the recording apparatus shown in FIG. 12, the head cartridge 1 shown in FIG. 1 has been exchangeably mounted on a carriage 102, being accurately positioned relative to the carriage 102. The carriage 102 is provided with an electrical contact portion for transmitting driving signals and the like to each ejection orifice column through the electrical contact portion 6 of the cartridge 1.

The carrier 102 is supported and guided by a guiding shaft 103, with which the recording apparatus main assembly is provided and which extends in the primary scanning movement direction. The carriage 102 is driven by a primary scan motor 104, through a drive train comprising a motor pulley 105, a follower pulley 106, a timing belt 107, and the like, while being controlled in position and movement. Further, the carriage 102 is provided with a home position sensor 130, which makes it possible to detect the position of the carriage 102 as the home position sensor 130 passes the position of a shield plate 136. A plurality of sheets of a recording medium 8, for example, printing paper or thin plastic plate, placed in an automatic sheet feeder 132 (which hereinafter will be referred to as an "ASF") are fed into the apparatus main assembly one by one while being separated from the rest of the sheets of the recording medium 8 in th ASF, by rotating a pickup roller 131 by a sheet feeder motor 135 through gears. Each sheet of recording medium 8 is further conveyed (in the secondary scan direction) through a portion (printing portion) at which it opposes the surface of the head cartridge 1, which is provided with the ejection orifices, by the rotation of the conveying roller 109, which is rotated by an LF motor 134 through gears. Whether or not a sheet of recording medium 8 has been fed into the apparatus main assembly, and the accurate position of the leading end of the recording medium 8, are determined as the recording medium 8 passes a paper end sensor 133.

The paper end sensor 133 is also used for determining the actual position of the trailing end of the recording medium 8, and also for ultimately determining the current recording position based on the actual position of the trailing end of the recording medium 8. The recording medium 8 is supported from the back side by a platen (unshown) so that the recording medium 8 provides a flat printing surface.

On the other hand, the head cartridge 1 is mounted on the carriage 102 in such a manner that the head cartridge surface with the ejection orifices projects downward from the carriage 102, and becomes parallel to the recording medium 8, in the area between the aforementioned two pairs of conveying rollers.

Further, the head cartridge 1 is mounted on the carriage 102 so that the direction of each ejection orifice column becomes perpendicular to the aforementioned direction of the primary scanning movement of the carriage 102, and recording is made by ejecting liquid from these ejection orifice columns. Incidentally, in the above-described embodiments, ink is ejected using thermal energy, and therefore, the head cartridge 1 is provided with electrothermal transducers for generating thermal energy. However, the present invention is also applicable to a head cartridge which employs a liquid ejection system other than the one described above, for example, piezoelectric elements, to eject ink, which is obvious.

As described above, according to the present invention, a liquid ejection recording head comprises: a plurality of recording elements having a plurality of ejection orifice columns which receive liquid from liquid containers dedicated to specific liquids one for one; and a plurality of ink supply paths, each of which forks at a predetermined point into a plurality of branches, the number of which corresponds to the number of the ejection orifice columns identical in liquid properties, and to which ink is supplied from the same ink supply path, so that each pair of ejection orifice columns identical in liquid properties are equalized in the manner in which liquid is supplied to them.

With the provision of this type of structure, one ink container is mounted for each liquid, making it possible to reduce component count, which in turn makes it possible to reduce the carriage size. Further, the ink container, the liquid content of which has been completely consumed, can be replaced with a new ink container following the same procedure as that which is followed when an empty ink container in a conventional recording head in which the ink supply paths are asymmetrically disposed, is replaced. In other words, the empty ink container in the recording head in accordance with the present invention can be replaced just as easily as the ink container in a conventional recording head, following the procedure easily understandable by a user.

In addition, a plurality of ejection orifice columns identical in ink properties can be virtually equalized in the amount of the resistance (pressure loss, the amount of which is determined by the ink supply path length, ink supply path cross section, maximum liquid velocity, ink viscosity, and the like) to the pressure which occurs as the liquid flows from an ink container to the correspondent ejection orifice columns. Therefore, the plurality of ejection orifice columns identical in ink properties can be equalized in the properties regarding liquid ejection for recording, and removal of the bubbles within the supply paths.

While the invention has been described with reference to the structures disclosed herein, it is not confined to the details set forth, and this application is intended to cover such modifications or changes as may come within the purposes of the improvements or the scope of the following claims.

What is claimed is:

1. A liquid ejection recording head comprising:

a plurality of arrays of ejection outlets for ejecting the same liquid;

common chambers, provided for respective arrays of the ejection outlets, for supplying the liquid to the arrays of the ejection outlets, respectively:

a liquid inlet for receiving the liquid from outside of said liquid ejection recording head;

a common passage in fluid communication with said liquid inlet;

branched passages branched from said common passage and in fluid communication with said common chambers, respectively, wherein said branched passages have liquid supply properties which are equivalent to each other, and wherein one end of the common passage is connected with the liquid inlet, and the other end of the common passage is connected to the branched passages.

2. A liquid ejection recording head according to claim 1, wherein the liquid is magenta ink.

3. A liquid ejection recording head according to claim 1, wherein the liquid is cyan ink.

4. A liquid ejection recording head according to claim 1, wherein said branched passages are symmetrical with respect to a line perpendicular to a scanning line along which said liquid ejection recording head is moved for scanning.

5. A liquid ejection recording head according to claim 1, wherein said common passage and branched passages each constitute a Y-shape, respectively.

6. A liquid ejection recording head according to any one of claims 1–5, wherein said liquid ejection recording head is moved bidirectionally for scanning.

7. A liquid ejection recording head comprising:

a first plurality of arrays of first ejection outlets for ejecting the same first liquid;

a second plurality of arrays of second ejection outlets for ejecting the same second liquid which is different from the first liquid;

a third plurality of arrays of third ejection outlets for ejecting the same third liquid which is different from the first liquid and from the second liquid;

first common chambers, provided for respective first arrays of the ejection outlets, for supplying the first liquid to the first arrays of the ejection outlets, respectively;

second common chambers, provided for respective second arrays of the ejection outlets, for supplying the second liquid to the second arrays of the ejection outlets, respectively;

third common chambers, provided for respective third arrays of the ejection outlets, for supplying the third liquid to the third arrays of the ejection outlets, respectively;

a first liquid inlet for receiving the first liquid from outside of said liquid ejection recording head;

a second liquid inlet for receiving the second liquid from outside of said liquid ejection recording head;

a third liquid inlet for receiving the third liquid from outside of said liquid recording head;

a first common passage in fluid communication with said first liquid inlet;

a second common passage in fluid communication with said second liquid inlet;

a third common passage in fluid communication with said second liquid inlet and with said third common chamber;

first branched passages branched from said first common passage and in fluid communication with said first common chambers, respectively, second branched passages branched from said second common passage and in fluid communication with said second common chambers, respectively, wherein said first branched passages have liquid supply properties which are equivalent to each other, and said second branched passages have liquid supply properties which are equivalent to each other, and wherein one end of the first common passage is connected with the liquid inlet, and the other end of the first common passage is connected to the first branched passages; one end of the second common passage is connected with the liquid inlet; the other end of the second common passage is connected to the second branched passages; and one end of the third common passage is connected with the liquid inlet, and the other end of the third common passage is connected to the third common chambers.

8. A liquid ejection recording head according to claim 7, wherein the first liquid is magenta ink, and the second liquid is cyan ink.

9. A liquid ejection recording head according to claim 7, wherein the third liquid is yellow ink.

10. A liquid ejection recording head according to claim 7, wherein said first branched passages are symmetrical with respect to a line perpendicular to a scanning line along which said recording head is moved for scan, and said second branched passages are symmetrical with respect to the line, and wherein said third common passages is on the line.

11. A liquid ejection recording head according to claim 7, wherein said first and second common passages and first and second branched passages constitute Y-shapes, respectively.

12. A liquid ejection recording head according to any one of claims 7–11, wherein said liquid ejection recording head is moved bidirectionarily for scanning.

13. A liquid ejection type recording device comprising a liquid ejection recording head as defined in any one of claims 1–12, wherein recording is effected on the recording material by ejecting liquid droplets from selected ejecting portions of said liquid ejection recording head with scanning movement of the carriage.

14. A liquid ejection recording head according to claim 1 or 7, wherein said liquid supply paths are constituted by connection only of an ink supply unit provided with a supply port and a plurality of supply passage formation assemblies.

15. A liquid ejection recording head comprising:

a first plurality of arrays of first ejection outlets for ejecting the same first liquid;

a second plurality of arrays of second ejection outlets for ejecting the same second liquid which is different from the first liquid;

first common chambers, provided for respective first arrays of the ejection outlets, for supplying the first liquid to the first arrays of the ejection outlets, respectively;

second common chambers, provided for respective second arrays of the ejection outlets, for supplying the second liquid to the second arrays of the ejection outlets, respectively;

a first liquid inlet for receiving the first liquid from an outside of said liquid recording head;

a second liquid inlet for receiving the second liquid from an outside of said liquid recording head;

a first common passage in fluid communication with said first liquid inlet;

a second common passage in fluid communication with said second liquid inlet;

first branched passages branched from said first common passage and in fluid communication with said first common chambers, respectively, second branched passages branched from said second common passage and in fluid communication with said second common chambers, respectively, wherein said first branched passages have liquid supply properties which are equivalent to each other, and said second branched passages have liquid supply properties which are equivalent to each other, wherein one end of the first common passage is connected with the liquid inlet, and the other end thereof is connected to the first branched passages; one end of the second common passage is connected with the liquid inlet; the other end thereof is connected to the second branched passages; and said first plurality of arrays is disposed between one of said second arrays and another one of said second arrays.

* * * * *

UNITED STATES PATENT AND TRADEMARK OFFICE

CERTIFICATE OF CORRECTION

PATENT NO. : 6,592,202 B2
DATED : July 15, 2003
INVENTOR(S) : Kenta Udagawa et al.

It is certified that error appears in the above-identified patent and that said Letters Patent is hereby corrected as shown below:

Column 2,
Line 20, “differences” should read -- differences in --; and
Line 30, “an” should be deleted.

Column 8,
Line 36, “the-female” should read -- the female --.

Column 10,
Line 66, “described” should read -- describe --.

Column 12,
Line 33, “portion 41 a” should read -- portion 41a --.

Column 14,
Line 11, “;” should read -- , --.

Column 16,
Line 10, “FIG. 10(d), should read -- FIG. 10(d). --; and
Line 36, “41M2” (second occurrence) should read -- 41Y2 --.

Column 17,
Line 13, “head;” should read -- head, --; and
Line 58, “in the” should read -- in the --.

Column 20,
Line 49, “claims 1-12,” should read -- claims 1-5 or 7-11 --.

Signed and Sealed this

Second Day of March, 2004

JON W. DUDAS
*Acting Director of the United States Patent and Trademark Office*